United States Patent [19]

Taguchi et al.

[11] Patent Number: 5,051,349

[45] Date of Patent: Sep. 24, 1991

[54] HEAT DEVELOPABLE COLOR PHOTOSENSITIVE MATERIAL WITH SACCHARIDE

[75] Inventors: Toshiki Taguchi; Hiroyuki Hirai, both of Kanagawa, Japan

[73] Assignee: Fuji Photo Film Co., Ltd., Kanagawa, Japan

[21] Appl. No.: 490,199

[22] Filed: Mar. 8, 1990

[30] Foreign Application Priority Data

Mar. 9, 1989 [JP] Japan ..... 1-57629
Jul. 12, 1989 [JP] Japan ..... 1-179667

[51] Int. Cl.[5] ..... G03C 5/54; G03C 1/34

[52] U.S. Cl. ..... 430/559; 430/203; 430/216; 430/219; 430/551; 430/607; 430/617

[58] Field of Search ..... 430/203, 216, 219, 551, 430/607, 617, 559

[56] References Cited

U.S. PATENT DOCUMENTS 3,239,338 3/1966 Rogers ..... 430/216
4,587,206 5/1986 Sakaguchi et al. ..... 430/617
4,814,254 3/1989 Naito et al. ..... 430/617
4,820,622 4/1989 Hirai et al. ..... 430/203
4,859,564 8/1989 Tomiyama ..... 430/216

*Primary Examiner*—Richard L. Schilling
*Attorney, Agent, or Firm*—Sughrue, Mion, Zinn, Macpeak & Seas

[57] ABSTRACT

A heat developable color photographic material is disclosed, comprising a support having thereon at least a photosensitive silver halide, a binder, and a dye providing compound capable of releasing or forming a diffusible dye in correspondence or counter-correspondence to reduction of the silver halide to silver, said heat developable color photosensitive material further comprising a compound represented by formula (I):

$$C_{6n}(H_2O)_{5n+1} \quad (I)$$

wherein n represents an integer of 1 or more. The material exhibits excellent raw preservability and provides a stain-free color image having a high maximum density.

13 Claims, No Drawings

HEAT DEVELOPABLE COLOR PHOTOSENSITIVE MATERIAL WITH SACCHARIDE

FIELD OF THE INVENTION

This invention relates to a heat developable color photosensitive material and, more particularly, to a heat developable color photosensitive material which is excellent in raw preservability and provides a color image having a high maximum density with low stain.

BACKGROUND OF THE INVENTION

Heat developable photosensitive materials are well known in the art. For example, heat developable photosensitive materials and their processing techniques are described in *SHASHIN KOGAKU NO KISO "HI-GIN-EN SHASHIN-HEN"*, pp. 242–255 (1982).

Many methods have also been proposed for forming a color image by heat development. For example, methods for forming a color image by coupling between an oxidation product of a developing agent and a coupler are disclosed, e.g., in U.S. Pat. Nos. 3,531,286, 3,761,270, and 4,021,240, Belgian Patent 802,519, and *Research Disclosure,* issue of Sept., 1975, pp. 31–32.

However, since these conventional heat developable color photosensitive materials are of non-fixing type, a silver halide remains after image formation and causes gradual coloring of the white background when exposed to strong light or preserved for a long time. Besides, these materials generally require a relatively long time for development, and also the color image obtained suffers from high fog and has only a low image density.

To eliminate the above-described disadvantages, there has been proposed a method in which a photosensitive material is imagewise heated to form or release a diffusible dye and the dye is transferred to a mordanted image-receiving material with the aid of a solvent, such as water, as disclosed in U.S. Pat. Nos. 4,500,626, 4,483,914, 4,503,137, and 4,559,290, and JP-A-59-165054 (the term "JP-A" as used herein means an "unexamined published Japanese patent application").

The above-described method still has problems, such as requirement of high developing temperatures and insufficient stability of the photosensitive materials with time. Hence, improved methods have been suggested, in which heat development for dye transfer is conducted in the presence of a base precursor and a trace amount of water thereby to achieve development acceleration, reduction of developing temperature, and simplification of processing, as disclosed in JP-A-59-218443, JP-A-61-238056, and European Patent 210,660A2.

Also with respect to methods for obtaining a positive color image by heat development, various proposals have hitherto been made. For instance, U.S. Pat. No. 4,559,290 teaches a method of using a so-called DRR compound in an oxidized form which is incapable of releasing a dye in combination with a reducing agent or a precursor thereof. According to this image formation system, the reducing agent is oxidized on heat development in correspondence to the amount of exposed silver halide, and the reducing agent remaining non-oxidized reduces the oxidized DRR compound to make it release a diffusible dye. Further, European Patent 220,746A and Kokai Giho 87-6199, Vol. 12, No. 22 disclose heat developable color photosensitive materials using compounds capable of releasing a diffusible dye through the similar mechanism, i.e., compounds having an N-X bond (wherein X represents an oxygen atom, a nitrogen atom, or a sulfur atom) which is reductively split off to release a diffusible dye.

Since a processing solution commonly employed for ordinary photographic processing is not used in heat development systems, most of the above-described heat developable color photosensitive materials contain a base-generating agent making a pH high on processing or contain a combination of silver halide and an oxidizable dye providing compound or a combination of a reducing agent and a reducible dye-providing compound. Therefore, undesired dye release or dye forming reaction tends to proceed within the photosensitive material during preservation, and when those materials having undergone such a chemical change are development-processed, images obtained suffer from background stains arising from the dye released or formed with time.

SUMMARY OF THE INVENTION

An object of this invention is to improve raw preservability of a heat developable color photosensitive material comprising a support having thereon at least a photosensitive silver halide, a binder, and a dye providing compound capable of forming or releasing a diffusible dye in correspondence or counter-correspondence to reduction of the silver halide to silver.

The object of this invention is accomplished by a heat developable color photographic material comprising a support having thereon at least a photosensitive silver halide, a binder, and a dye providing compound capable of releasing or forming a diffusible dye in correspondence or counter-correspondence to reduction of the silver halide to silver, said heat developable color photosensitive material further comprising a compound represented by formula (I):

$$C_{6n}(H_2O)_{5n+1} \quad \text{(I)}$$

wherein n represents an integer of 1 or more.

DETAILED DESCRIPTION OF THE INVENTION

The compounds represented by formula (I) denote a group of compounds generally known as saccharides. These compounds are classified by the number of n into monosaccharides wherein $n=1$; oligosaccharides wherein $n=2$ to 6 (in particular, disaccharides wherein $n=2$); and polysaccharides wherein $n>6$.

Included in saccharides are naturally-occurring saccharides and artificial or synthetic saccharides. Properties of the saccharides are described in detail, e.g., H.S. El Khadem, *Carbohydrate Chemistry,* Academic Press Inc., London (1988), E. A. Davidson, *Carbohydrate Chemistry,* Holt Rinehart and Winston, Inc., U.S.A. (1967), and Egami and Nishizawa, *TANSUIKABUTSU,* Asakura Shoten, Tokyo (1966). The compounds according to the present invention are thus well-known compounds on which many reports have hitherto been made.

Cases of applying saccharides to the photographic field are described in JP-A-62-253159, in which polysaccharides, such as dextran, are utilized as hydrophilic binder. For achieving the purpose of the present invention, however, low-molecular weight compounds of formula (I) wherein n is 10 or less are preferred. While saccharides are also classified into reducing sugar and non-reducing sugar, both of them are applicable in the present invention.

Specific but non-limiting examples of the compound represented by formula (I) are glucose, fructose, furanose, pyranose, mannose, galactose, allose, altrose, idose, talose, lactose, sucrose, maltose, cellobiose, xylose, arabinose, ribose, tagatose, sorbose, erythrose, adnite, arabitol, mannitol, sorbitol, erythritol, raffinose, maltotriose, stachyose, starch, glycogen, cellulose, gum arabic, pectin, fucose, glucal, gluconic acid, lactone, glucosan, glucosamine, galactosamine, glucothiose, and dextran. Preferred of them are monosaccharides, oligosaccharides, and polysaccharides.

The amount of the compound of formula (I) to be used in the present invention is selected from a broad range. A preferred amount is from 0.1 to 50% by weight, and more preferably from 0.5 to 15% by weight, based on the binder. Where the compound of formula (I) is incorporated to a photosensitive material having a multi-layer structure, it may be added to any of photosensitive layers, interlayers, protective layers, and other layers. The compound may be added to some of layers in adequate amounts or may be concentrated in a selected layer.

The heat developable photosensitive material according to the present invention essentially comprises a support having thereon a photosensitive silver halide, a binder, and a dye providing compound (the dye providing compound sometimes serves as a reducing agent as hereinafter described). If desired, the photosensitive material contains an organic metal salt oxidizing agent, etc. These components are often incorporated into the same layer, but they may be incorporated separately into different layers as far as they are in a reactive state. For example, presence of a colored dye providing compound in a layer beneath a silver halide emulsion layer prevents reduction in sensitivity. A reducing agent is preferably incorporated into a heat developable photosensitive material. It may also be externally supplied through, for example, diffusion from a dye fixing material as hereinafter described.

To obtain colors within a wide range of a chromaticity diagram by using three primary colors of yellow, magenta, and cyan, at least three silver halide emulsion layers differing in spectral sensitivity should be used in combination. For example, a blue-sensitive layer, a green-sensitive layer, and a red-sensitive layer are combined; or a green-sensitive layer, a red-sensitive layer, and an infrared-sensitive layer are combined. The order of providing these layers is arbitrarily selected from those known for general color photosensitive materials. If desired, each photosensitive layer may be composed of two or more divided layers.

The heat developable photosensitive material can further contain auxiliary layers, such as protective layers, subbing layers, interlayers, yellow filter layers, antihalation layers, backing layers, etc.

Silver halide grains which can be used in the present invention may be any of silver chloride, silver bromide, silver iodobromide, silver chlorobromide, silver chloroiodide, and silver chloroiodobromide.

Silver halide emulsions may be either of a surface latent image type emulsion or an internal latent image type emulsion. Internal latent image type emulsions are used as direct reversal emulsions in combination with nucleating agents or light fog. The emulsion may be a so-called core/shell emulsion having different phases between the inside of the grains and the surface layer thereof. The emulsions may be either monodispersed or poly-dispersed. A mixture of mono-dispersed emulsions may also be used.

Silver halide grains have a mean grain size of from 0.1 to 2 μm, and preferably from 0.2 to 1.5 μm. The grains may have a regular crystal form, such as a cubic form, an octahedral form, and a tetradecahedral form, or an irregular crystal form, such as a tabular form having a high aspect ratio.

Specific examples of suitable silver halide emulsions are described in U.S. Pat. Nos. 4,500,626 (Col. 50) and 4,628,021, *Research Disclosure,* No. 17029 (1978), and JP-A-62-253159.

Silver halide emulsions may be used as primitive (unripened) but is usually used after being chemically sensitized by known techniques, such as sulfur sensitization, reduction sensitization, and nobel metal sensitization, either alone or in combination thereof. Chemical sensitization may be performed in the presence of a nitrogen-containing heterocyclic compound as suggested in JP-A-62-253159.

The photosensitive silver halide emulsion is usually coated on a support to a silver coverage of from 1 mg to 10 g/m$^2$.

As stated above, an organometallic salt can be used as an oxidizing agent in combination of photosensitive silver halide emulsions. Of organometallic salts, organic silver salts are particularly preferred.

Organic compounds forming organic silver salt oxidizing agents include benzotriazoles, fatty acids, and other compounds as described in U.S. Pat. No. 4,500,626, Cols. 52–53. In addition, silver salts of alkynyl-containing carboxylic acids, e.g., silver phenylpropiolate, as described in JP-A-60-113235 and acetylene silver as described in JP-A-61-249044 are also useful. These organic silver salts may be used either individually or in combination of two or more thereof.

The organic silver salt is usually used in an amount of from 0.01 to 10 mols, and preferably from 0.01 to 1 mol, per mol of photosensitive silver halide. The total silver coverage of the photosensitive silver halide and the organic silver salt suitably ranges from 50 mg to 10 g/m$^2$.

In the present invention, various antifoggants or stabilizers can be used. Examples thereof include azoles or azaindenes described in *Research Disclosure,* No. 17643, pp. 24–25 (19978), nitrogen-containing carboxylic acids or phosphoric acids described in JP-A-59-168442, mercapto compounds and metal salts thereof described in JP-A-59-111636, and acetylene compounds described in JP-A-62-87957.

Silver halides which can be used in the present invention may be spectrally sensitized with methine dyes or others. Spectral sensitizing dyes include cyanine dyes, merocyanine dyes, complex cyanine dyes, complex merocyanine dyes, holopolar cyanine dyes, hemicyanine dyes, styryl dyes, and hemioxonol dyes. Specific examples of these sensitizing dyes are described in U.S. Patent 4,617,257, JP-A-59-180550, JP-A-60-140335, and *Research Disclosure,* No. 17029 (1978), pp. 12–13.

The sensitizing dyes may be used either individually or in combination thereof. Combinations of sensitizing dyes are often used for the purpose of supersensitization.

Photographic emulsion may contain a compound which exhibits no spectral sensitizing effect by itself or substantially absorbs no visible light but which shows supersensitizing effect in combination with the sensitizing dye. Examples of such a compound are described, e.g., in U.S. Pat. No. 3,615,641 and JP-A-63-23145.

The sensitizing dyes may be added to an emulsion during, before or after chemical ripening. They may also be added before or after nucleation of silver halide grains as taught in U.S. Pat. Nos. 4,183,756 and 4,225,666. The amount of the sensitizing dye to be added generally ranges from about $10^{-8}$ to $10^{-2}$ mol, per mol of silver halide.

Binders to be used in constituent layers of photosensitive materials or dye fixing materials are preferably hydrophilic. Examples of suitable hydrophilic binders are described in JP-A-62-253159, pp. 26–28. Transparent or semi-transparent binders are preferred. Included in such hydrophilic binders are naturally occurring compounds, such as proteins (e.g., gelatin and derivatives thereof) and cellulose derivatives; and synthetic high polymers, such as polyvinyl alcohol, polyvinylpyrrolidone, and acrylamide polymers. Also useful as binder are highly water-absorbing polymers described in JP-A-62-245260 including homo- or copolymers of a vinyl monomer(s) having —COOM or —$SO_3M$ (wherein M is a hydrogen atom or an alkali metal) and copolymers of such a vinyl monomer and other vinyl monomer(s) [e.g., sodium methacrylate, ammonium methacrylate, and Sumikagel® L-5H (produced by Sumitomo Chemical Co., Ltd.)]. These binders may be used in combinations of two or more thereof.

In a system wherein heat development is effected with a slight amount of water, use of the above-described highly water-absorbing polymer expedites absorption of water. Further, use of the highly water-absorbing polymer in a dye fixing layer or a protective layer thereof prevents the transferred dye from being re-transferred from the dye fixing material to other materials.

In particular, a combination of gelatin and polyvinyl alcohol is a preferred binder system for use in combination with the polysaccharides according to the present invention.

Gelatin which can be used as a binder includes lime-processed gelatin, acid-processed gelatin, and enzyme-processed gelatin as described in *Bull. Soc. Sci. Photo. Japan,* No. 16, p. 30 (1966). Hydrolysis products or enzymatic decomposition products of gelatin are also useful. Further, gelatin derivatives, graft polymers of gelatin with other polymers, and crosslinking products of gelatin with hardening agents are employable.

Polyvinyl alcohol which can be used as a binder may have wide ranges of degree of polymerization and degree of saponification. A suitable average degree of polymerization is 300 or more, and preferably 1,000 or more, and a suitable degree of saponification is 60 mol% or more, and preferably 80 mol% or more.

A gelatin coverage in the photosensitive material of the present invention is 20 g or less, preferably 10 g or less, and more preferably 7 g or less, per $m^2$. Polyvinyl alcohol is used in an amount of from 0.1 to 50% by weight, and preferably from 0.5 to 20% by weight, based on the gelatin and from 5 to 500% by weight based on the compound of formula (I), respectively.

A total coverage of a binder is preferably 20 g or less, more preferably 10 g or less, and most preferably 7 g or less, per $m^2$.

Layers constituting the photosensitive material or dye fixing material inclusive of a backing layer may contain various polymer latices for the purpose of improving film properties, for example, improvement in dimensional stability, prevention of curling, blocking or cracking, and prevention of pressure sensitization or desensitization. To this effect, any of the polymer latices described in JP-A-62-245258, JP-A-62-136648, and JP-A-62-110066 can be used. In particular, incorporation of a polymer latex having a low glass transition point (i.e., 40° C. or lower) into a mordanted layer is effective to prevent cracking of the mordanted layer, while incorporation of a polymer latex having a high glass transition point into a backing layer produces anticurling effects.

Reducing agents which can be used in the present invention are selected from those conventional in the field of heat developable photosensitive materials. Reducing dye providing compounds hereinafter described are also included in reducing agents. The dye providing compounds may be used in combination with other reducing agents. In addition, reducing agent precursors which have no reducing effect per se but are capable of exhibiting a reducing effect on reaction with a nucleophilic reagent or on heating at the time of development can also be used.

Specific examples of suitable reducing agents inclusive of precursors which can be used in this invention are described in U.S. Pat. Nos. 4,500,626 (Cols. 49-50), 4,483,914 (Cols. 30-31), 4,330,617, and 4,590,152, JP-A-60-140335 (pp. 17–18), JP-A-57-40245, JP-A-56-138736, JP-A-59-178458, JP-A-59-53831, JP-A-59-182449, JP-A-59-182450, JP-A-60-119555, JP-A-60-128436 to 128439, JP-A-60-198540 JP-A-60-181742, JP-A-61-259253, JP-A-62-244044, JP-A-62-131253 to 131256, and European Patent 220,746A2 (pp. 78–96).

Combinations of various reducing agents as disclosed in U.S. Pat. No. 3,039,869 can also be used.

If desired, where a non-diffusible reducing agent is employed, an electron transfer agent and/or a precursor thereof may be used in combination to thereby accelerate electron transfer between the non-diffusible reducing agent and the developable silver halide.

Such an electron transfer agent or a precursor thereof can be selected from the above-described reducing agents or precursors thereof. It is desirable that the electron transfer agent or its precursor has greater mobility than the nondiffusible reducing agent (i.e., electron donor). Particularly useful electron transfer agents are 1-phenyl-3-pyrazolidones or aminophenols.

The non-diffusible reducing agent (electron donor) to be combined with the electron transfer agent is selected from the above-described reducing agents as long as it is substantially immobile in the layer where they belong. Suitable examples of such a non-diffusible reducing agent include hydroquinones, sulfonamidophenols, sulfonamidonaphthols, compounds described as electron donors in JP-A-53-110827, and non-diffusible reducing dye providing compounds as hereinafter described.

The amount of the reducing agent to be used in the present invention usually ranges from 0.001 to 20 mols, and preferably from 0.01 to 10 mols, per mol of silver.

Typical examples of the dye providing compounds which can be used in the present invention include compounds capable of forming a dye on oxidative coupling reaction with a color developing agent (i.e., couplers). Such compounds may be either 4-equivalent couplers or 2-equivalent couplers. Two-equivalent couplers having a non-diffusible group as a split-off group and capable of forming a diffusible dye upon oxidative coupling reaction are preferably used. The non-diffusible group may comprise a polymer chain.

Specific examples of color developing agents and couplers are described in T. H. James, *The Theory of the Photographic Process* (4th Ed.), pp. 291–334 and 354–361, JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474, and JP-A-60-66249.

Further included in the dye providing compounds are compounds having a function of imagewise releasing or diffusing a diffusible dye. Such compounds can be represented by formula (LI):

$$(\text{Dye}—\text{Y})_n—\text{Z} \qquad \text{(LI)}$$

wherein Dye represents a dye group, a dye group which has been temporarily shifted to a short wavelength region, or a dye precursor group; Y represents a mere bond or a linking group; Z represents a group which produces a difference in the diffusibility of the compound represented by $(\text{Dye}—\text{Y})_n—\text{Z}$ or releases a dye to produce a difference in diffusibility between the thus released Dye and $(\text{Dye}—\text{Y})_n—\text{Z}$ in correspondence or counter-correspondence to photosensitive silver salts having an imagewise distributed latent image; and n represents 1 or 2. When n is 2, two Dye-Y moieties may be the same or different.

Specific examples of the dye providing compounds represented by formula (LI) include the following compounds (i) to (v). Compounds (i) to (iii) form a diffusible dye image (positive dye image) in counter-correspondence to development of silver halide, while compounds (iv) and (v) form a diffusible dye image (negative dye image) in correspondence to development of silver halide.

(i) Dye developing agents comprising a hydroquinone developing agent connected to a dye component as described in U.S. Pat. Nos. 3,134,764, 3,362,819, 3,597,300, 3,544,545, and 3,482,972. The compounds of this type are diffusible in alkaline conditions but become non-diffusible on reaction with silver halide.

(ii) Non-diffusible compounds which release a diffusible dye in alkaline conditions but lose their function on reaction with silver halide. Examples of such compounds include compounds which undergo intramolecular nucleophilic displacement to release a diffusible dye as described in U.S. Pat. No. 3,980,479, and compounds which undergo intramolecular rewinding of the isooxazolone ring to release a diffusible dye as described in U.S. Pat. No. 4,199,354.

(iii) Non-diffusible compounds which react with a reducing agent remaining non-oxidized after development to release a diffusible dye as described in U.S. Pat. No. 4,559,290, European Patent 220,746A2, U.S. Pat. No. 4,783,396, and Kokai Giho 87-6199. Examples of such compounds include compounds which undergo intramolecular nucleophilic displacement after being reduced to release a diffusible dye as described in U.S. Pat. Nos. 4,139,389 and 4,139,379, JP-A-59-185333, and JP-A-57-84453, compounds which undergo intramolecular electron transfer after being reduced to release a diffusible dye as described in U.S. Pat. No. 4,232,107, JP-A-59-101649, JP-A-61-88257, and *Research Disclosure*, No. 24025 (1984), compounds whose single bond is cleaved after being reduced to release a diffusible dye as described in West German Patent 3,008,588A, JP-A-56-142530, and U.S. Pat. Nos. 4,343,893 and 4,619,884, nitro compounds which receive electrons to release a diffusible dye as described in U.S. Pat. No. 4,450,223, and compounds which receive electrons to release a diffusible dye as described in U.S. Pat. No. 4,609,610.

Preferred examples of the compounds of this type include compounds having an N-X bond (wherein X represents an oxygen, sulfur or nitrogen atom) and an electrophilic group per molecule as described in European Patent 220,746A2, Kokai Giho 87-6199, U.S. Pat. No. 4,783,396, JP-A-63-201653, and JP-A-63-201654, compounds having an $SO_2$—X (wherein X is as defined above) and an electrophilic group per molecule as disclosed in U.S. Application Ser. No. 07/188,779 (corresponding to JP-A-1-26842), compounds having a PO-X bond (wherein X is as defined above) and an electrophilic group per molecule as disclosed in JP-A-63-271344, and compounds having a C—X' bond (wherein X' represented by formula (LI) include the following compounds (i) has the same meaning as X or represents —$SO_2$—) and an electrophilic group per molecule as disclosed in JP-A-63-271341.

Further, compounds in which after reduction by a n-bond conjugated with an electron accepting group, a single bond is cleaved to release a diffusible dye, as described in JP-A-1-161237 and JP-A-1-161342, can also be used.

Especially preferred of these compounds are the compounds having an N—X bond and an electrophilic group per molecule. Specific examples of the compounds are Compound Nos. (1) to (3), (7) to (10), (12), (13), (15), (23) to (26), (31), (32), (35), (36), (40), (41), (44), (53) to (59), (64), and (70) described in European Patent 220,746A2 or U.S. Pat. No. 4,783,396 and Compound Nos. (11) to (23) described in Kokai Giho 87-6199.

(iv) Compounds having a diffusible dye as a split-off group which are capable of releasing a diffusible dye on reaction with an oxidation product of a releasing agent (DRR couplers). Specific examples of the compounds of this type are described in British Patent 1,330,524, JP-B-48-39165 (the term "JP-B" as used herein means an "examined Japanese patent publication"), and U.S. Pat. Nos. 3,443,940, 4,474,867, and 4,483,914.

(v) Compounds having a reducing effect on silver halide or organic silver salts which release a diffusible dye upon exerting the reducing effect (DRR couplers). Since the compounds of this type do not need other reducing agents, image staining due to oxidative decomposition products of reducing agents can be eliminated. Typical examples of these compounds are described in U.S. Pat. Nos. 3,928,312, 4,053,312, 4,055,428, and 4,336,322, JP-A-59-65839, JP-A-59-69839, JP-A-53-3819, JP-A-51-104343, A-51-104343, *Research Disclosure* 17465, U.S. Pat. Nos. 3,725,062, 3,728,113, and 3,443,939, JP-A-58-116537, JP-A-57-179840, and U.S. Pat. No. 4,500,626. Specific examples of the DRR compounds include the compounds of Cols. 22 to 44 of U.S. Pat. No. 4,500,626 supra. Among them, particularly preferred are Compound Nos. (1) to (3), (10) to (13), (16) to (19), (28) to (30), (33) to (35), (38) to (40), and (42) to (64). The compounds described in U.S. Pat. No. 4,639,408, Cols. 37 to 39 are also useful.

In addition to the above-described couplers and the compounds of formula (LI), the dye providing compounds which can be used in the present invention include silver dye compounds comprised of an organic silver salt connected to a dye as disclosed in Research Disclosure, Issue of May, 1978, pp. 54–58; azo dyes for use in heat development silver dye bleach process as disclosed in U.S. Pat. No. 4,235,957 and *Research Disclosure,* Issue of Apr., 1976, pp. 30–32; and leuco dyes as described in U.S. Pat. Nos. 3,985,565 and 4,022,617.

Hydrophobic additives such as dye providing compounds and non-diffusible reducing agents can be introduced into layers of photosensitive materials by known techniques as described in U.S. Pat. No. 2,322,027. In this case, high-boiling organic solvents, e.g., those described in JP-A-59-83154, JP-A-59-178451 to 178455, and JP-A-59-178457, may be used either alone or, if desired, in combination with low-boiling organic solvents having a boiling point of from 50° to 160° C.

The high-boiling organic solvent is usually used in an amount not more than 10 g, and preferably not more than 5 g, per gram of the dye providing compound; and not more than 1 ml, preferably not more than 0.5 ml, and more preferably not more than 0.3 ml, per gram of the binder.

The dispersion method using polymerization products as described in JP-B-51-39853 and JP-A-51-59943 is also employed for incorporation of the hydrophobic additives.

Where the additive to be introduced is substantially water-insoluble, it may be incorporated into the binder in the form of a dispersion of finely divided particles as well.

To disperse hydrophobic compounds in a hydrophilic colloid, various surface active agents can be made use of. For example, surface active agents described in JP-A-59-157636, pp. 37–38 are suitable.

In the present invention, a compound which serves both to accelerate development of photosensitive materials and to stabilize images can be used. Suitable examples of such a compound are described in U.S. Pat. 4,500,626, Cols. 51–52.

In a system where an image is formed by diffusion transfer of a dye, a photosensitive material is used in combination with a dye fixing material. The photosensitive material and the dye fixing material may be constructed on the same support or separate supports. With respect to mutual relationship between the photosensitive material and the dye fixing material, relationship of these materials to a support, and relationship of these materials to a white reflecting layer, reference can be made in U.S. Pat. No. 4,500,626, Col. 57.

The dye fixing material which can be used in the present invention preferably comprises at least one layer containing a mordant and a binder. Mordants to be used are well known in the art, and specific examples thereof are described in U.S. Pat. No. 4,500,626, Cols. 58–59, JP-A-61-88256 (pp. 32–41), JP-A-62-244043, and JP-A-62-244036. Dye accepting high-molecular weight compounds as described in U.S. Pat. No. 4,463,079 may also be used as mordants.

If desired, the dye fixing material may further comprise auxiliary layers, such as a protective layer, a release layer, and an anticurling layer. Formation of a protective layer is especially useful.

Constituent layers of the photosensitive material and dye fixing material may contain high-boiling organic solvents as a plasticizer, a lubricant or an agent for improving releasability between a photosensitive material and a dye fixing material. Specific examples of usable high-boiling organic solvents are described in JP-A-62-253159 (p. 25) and JP-A-62-245253. For the same purposes, various kinds of silicone oil (inclusive of from dimethylsilicone oil to modified silicone oils comprising dimethylsiloxane having introduced thereinto various organic groups) can also be used. Examples of effective silicone oils are modified silicone oils of various kinds, and particularly carboxyl-modified silicone oil ("X-22-3710" produced by Shin-Etsu Silicone Co., Ltd.) described in pp. 6–8 of "Modified Silicone Oil", technical data reported by Shin-Etsu Silicone Co., Ltd. Silicone oils described in JP-A-62-215953 and JP-A-63-46449 are also effective.

The photosensitive material and dye fixing material may contain discoloration inhibitors, such as antioxidants, ultraviolet absorbents, and a certain kind of metal complexes.

Examples of suitable antioxidants include chroman compounds, coumaran compounds, phenol compounds (e.g., hindered phenols), hydroquinone derivatives, hindered amine derivatives, and spiroindane compounds. Compounds described in JP-A-61-159644 are also effective.

Examples of suitable ultraviolet absorbents include benzotriazole compounds (e.g., those described in U.S. Pat. No. 3,533,794), 4-thiazolidone compounds (e.g., those described in U.S. Pat. No. 3,352,681), benzophenone compounds (e.g., those described in JP-A-46-2784), and compounds described in JP-A-54-48535, JP-A-62-136641, and JP-A-61-88256. Ultraviolet absorbing polymers as described in JP-A-62-260152 are also effective.

Metal complexes useful as discoloration inhibitors include compounds described in U.S. Pat. Nos. 4,241,155, 4,245,018 (Cols. 3–36), and 4,254,195 (Cols. 3–8), JP-A-62-174741, JP-A-61-88256 (pp. 27–29), JP-A-63-199248, JP-A-1-75568, and JP-A-1-74272.

Examples of useful discoloration inhibitors are described in JP-A-62-215272, pp. 125–137.

The discoloration inhibitor for preventing the dye transferred to a dye fixing material from discoloring may be previously incorporated into the dye fixing material or may be supplied to the dye fixing material externally from, for example, a photosensitive material.

The above-described antioxidants, ultraviolet absorbents and metal complexes may be used in combination thereof.

The photosensitive material or dye fixing material may further contain a fluorescent brightening agent. It is preferable that such a fluorescent brightening agent is incorporated into the dye fixing material or supplied to the dye fixing material externally from, for example, the photosensitive material. Examples of fluorescent brightening agents which can be used are compounds described in K. Veenkataraman (ed.), *The Chemistry of Synthetic Dyes,* Vol. V, Ch. 8 and JP-A-61-143752, including stilbene compounds, coumarin compounds, biphenyl compounds, benzoxazolyl compounds, naphthalimide compounds, pyrazoline compounds, and carbostyril compounds. These fluorescent brightening agents may be used in combination with the above-described discoloration inhibitors.

Hardening agents which can be used in layers constituting the photosensitive material or dye fixing material include those described in U.S. Pat. No. 4,678,739 (Col. 41), JP-A-59- 116655, JP-A-62-245261, and JP-A-61-18942. Specific examples of suitable hardening agents are aldehyde hardening agents (e.g., formaldehyde), aziridine hardening agents, epoxy hardening agents

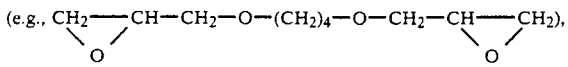

vinyl-sulfone hardening agents (e.g., N,N'-ethylenebis(-vinylsulfonylacetamido)ethane), N-methylol hardening agents (e.g., dimethylolurea), and high-molecular weight hardening agents (e.g., the compounds described in JP-A-62-234157).

Layers constituting the photosensitive material or dye fixing material can contain various surface active agents for the purpose of coating aid, improvement of release, improvement of slip properties, prevention of static charge, and acceleration of development. Specific examples of suitable surface active agents are described in JP-A-62-173463 and JP-A-62-183457.

Layers constituting the photosensitive material or dye fixing material can further contain organofluoro compounds for the purpose of improvement of slip properties, prevention of static charge, and improvement of release. Typical examples of the organofluoro compounds are fluorine-containing surface active agents as described in JP-B-57-9053 (Cols. 8-17), JP-A-61-20944, and JP-A-62-135826, and hydrophobic fluorine compounds, such as oily fluorine compounds (e.g., fluorine oil) and solid fluorine compound resins (e.g., tetrafluoroethylene resin).

The photosensitive material or dye fixing material may also contain a matting agent, such as the compounds described in JP-A-61-88256 (pp. 29) (e.g., silicon dioxide, polyolefins, and polymethacrylates), and the compounds described in JP-A-63-274944 and JP-A-63-274952 (e.g., benzoguanamine resin beads, polycarbonate resin beads, and AS resin beads).

Layers constituting the photosensitive material or dye fixing material may further contain other additives, such as thermal solvents, defoaming agents, antiseptic biocides, and colloidal silica. Specific examples of these additives are described in JP-A-61-88256 (pp. 26-32).

The photosensitive material or dye fixing material may furthermore contain image formation accelerators. Image formation accelerators have functions to accelerate reduction-oxidation reaction between a silver salt oxidizing agent and a reducing agent, to accelerate dye formation of a dye providing compound or decomposition of the dye or release of a diffusible dye from a dye providing compound, and to accelerate transfer of a dye from a photosensitive layer to a dye fixing layer. From the viewpoint of physicochemical functions, image formation accelerators are classified into bases or base precursors, nucleophilic compounds, high-boiling organic solvents (oils), thermal solvents, surface active agents, and compounds interacting with silver or silver ion. Note that these groups of substances generally have composite functions to exhibit some of the above-described accelerating effects combined. For the details, reference can be made in U.S. Pat. No. 4,678,739 (Cols. 38-40).

Examples of base precursors include salts of an organic acid which is decarboxylated on heating and a base, and compounds which undergo intramolecular nucleophilic substitution, Lossen rearrangement or Beckman rearrangement to release an amine compound. Specific examples of the base precursors are described in U.S. Pat. No. 4,511,493 and JP-A-62-65038.

In a system where heat development and dye transfer are simultaneously conducted in the presence of a small amount of water, it is preferable for improving preservability of the photosensitive material to incorporate a base and/or a base precursor into the dye fixing material.

Other examples of suitable base precursors include a combination of a sparingly soluble metallic compound and a complexing compound capable of complexing with metal ions constituting the metallic compound as described in European Patent Publication 210,660 and U.S. Pat. No. 4,740,445 and a compound capable of forming a base by electrolysis as described in JP-A-61-232451. The former compound combination is particularly effective. The sparingly soluble metallic compound and the complexing compound are advantageously added separately in the photosensitive material and the dye fixing material.

The photosensitive material and/or dye fixing material may contain various development stopping agents for the purpose of obtaining images of constant quality irrespective of variations in temperature and time of development. The terminology "development stopping agent" as used herein means a compound which, after proper development, rapidly neutralizes a base or reacts with a base to reduce the base concentration in the film to thereby stop development or a compound which, after proper development, interacts with silver or a silver salt to inhibit development. Examples of such a development stopping agent include acid precursors which release an acid on heating, electrophilic compounds which undergo displacement reaction with a co-existing base on heating, and nitrogen-containing heterocyclic compounds, mercapto compounds and precursors thereof. For details, reference can be made in JP-A-62-253159 (pp. 31-32).

Supports which can be used in the photosensitive material or dye fixing material should withstand a processing temperature and generally include paper and synthetic resin films. Specific examples of suitable supports are films of polyethylene terephthalate, polycarbonate, polyvinyl chloride, polystyrene, polypropylene, polyimides, and cellulose derivatives (e.g., triacetyl cellulose), films of these synthetic resins having incorporated therein pigments, e.g., titanium oxide, synthetic paper films made of polypropylene, etc., mixed paper prepared from a synthetic resin pulp (e.g., polyethylene) and a natural pulp, Yankee paper, baryta paper, coated paper (particularly cast coat paper), metals, fabrics, glass, and the like.

These supports may be used either alone or in the form of a sheet laminated with a synthetic high polymer, e.g., polyethylene, on one or both sides thereof.

In addition, the supports described in JP-A-62-253159 (pp. 29-31) are also employed.

The surface of the support may be coated with a hydrophilic binder and a semiconducting metal oxide (e.g., alumina sol and tin oxide), carbon black or other antistatic agents.

Image formation or recording on the photosensitive material by exposure is performed by a process comprising directly photographing scenery or persons with a camera, etc., a process comprising exposing the photosensitive material to light through a reversal film or a negative film by using a printer or an enlarger, a process comprising scanning exposing an original through a slit by using an exposing means of a copying machine, etc., a process comprising exposing the photosensitive material to light emitted from a light-emitting diode (LED) or a laser by electrical signals converted from image information, and a process comprising putting image information into an image display device, e.g., a CRT, a liquid crystal display, an electroluminescence display, and a plasma display, and exposing the photosensitive material to light emitted therefrom directly or through an optical system.

Light sources for recording images on the photosensitive material include natural light, a tungsten lamp, an LED, a laser light source, and a CRT light source as described in U.S. Pat. No. 4,500,626, Col. 56.

Imagewise exposure may also be carried out by using a wavelength conversion element comprising a combination of a nonlinear optical material and a coherent light source such as a laser. The terminology "nonlinear optical material" as used herein means a material capable of realizing nonlinearity between polarization appearing when a strong opto-electrical field, such as a laser beam, is applied and an electrical field. Suitable examples of such a material include inorganic compounds, e.g., lithium niobate, potassium dihydrogenphosphate (KDP), lithium iodate, and $BaB_2O_4$; urea derivatives; nitroaniline derivatives; nitropyridine-N-oxide derivatives, e.g., 3-methyl-4-nitropyridine-N-oxide (POM), and compounds described in JP-A-61-53462 and JP-A-62-210432. Known wavelength conversion elements include a single crystal optical waveguide mode and a fiber mode, both of which can be used in the present invention.

Image information which can be recorded on the photosensitive material includes picture signals obtained from a video camera, an electron still cameral, etc., TV signals according to Nippon Television Signal Code (NTSC), picture signals obtained by dividing an original into many pixels by means of a scanner ot the like, and picture signals produced by means of a computer represented by CG or CAD.

The photosensitive material and/or dye fixing material may have an electrically conductive heating element layer as a heating means for heat development or dye diffusion transfer. In this case, transparent or opaque heating elements described in JP-A-61-145544 can be utilized. The electrically conductive layer also serves as an antistatic layer.

The heating temperature for heat development is from about 50° C. to about 250° C. and preferably from about 80° C. to about 180° C. The dye diffusion transfer process may be carried out simultaneously with or after heat development. In the latter case, transfer can be effected at a temperature of from room temperature up to the heat developing temperature, particularly from 50° C. to a temperature about 10° C. lower than the heat developing temperature.

Transfer of a dye can be effected only by heat application. A solvent may be used to accelerate dye transfer. It is also effective to heat the photosensitive material in the presence of a small amount of a solvent, particularly water, to conduct development and transfer simultaneously or successively as described in JP-A-59-218443 and JP-A-61-238056. The heating temperature in this system is preferably from 50° C. to the boiling point of the solvent used. For example, when in using water as a solvent, the heating temperature preferably ranges from 50° C. to 100° C.

Examples of solvents to be used for acceleration of development and/or transfer of a diffusible dye to the dye fixing layer include water and a basic aqueous solution containing an organic alkali metal salt or an organic base, such as those described with respect to the image formation accelerators. Low-boiling solvents or a mixed solvent of a low-boiling solvent and water or a basic aqueous solution may also be used as a solvent. The solvent may contain a surface active agent, an antifoggant, or a combination of a sparingly soluble metallic salt and a complexing compound.

These solvents can be supplied to either one or both of the dye fixing material and the photosensitive material. The amount of the solvent to be used may be as small as not more than the weight of the solvent of the volume corresponding to the maximum swelling volume of the total coated films, particularly no more than the value obtained by subtracting the weight of the total coated films from the weight of the solvent of the volume corresponding to the maximum swelling volume of the total coated films.

The solvent can be supplied to the photosensitive layer or dye fixing layer by known methods, for example, the method of JP-A-61-147244 (pp. 26). The solvent may be previously incorporated into the photosensitive material and/or the dye fixing material in an enclosed form, such as a microcapsule form.

In order to accelerate dye transfer, a hydrophilic thermal solvent which is solid at room temperature but dissolves at an elevated temperature may be incorporated into either one or both of the photosensitive material and the dye fixing material. Layers in which the thermal solvent is to be incorporated may be any of emulsion layers, interlayers, protective layers, and dye fixing layers. It is preferable to incorporate the thermal solvent into the dye fixing layer and/or a layer adjacent thereto.

Examples of suitable hydrophilic thermal solvents are ureas, pyridines, amides, sulfonamides, imides, anisoles, oximes, and other heterocyclic compounds.

In order to accelerate dye transfer, a high-boiling organic solvent may be incorporated into the photosensitive material and/or the dye fixing material.

Heating for development and/or dye transfer can be carried out by contacting the photosensitive material with a heated block or plate, a heating plate, a hot presser, a heat roller, a halogen lamp heater, an infrared or far infrared lamp heater, etc. or passing the photosensitive material in a high temperature atmosphere.

With respect to pressure conditions and processes of pressure application in bringing the photosensitive material and the dye fixing material into intimate contact, the disclosure of JP-A-61-147244, pp. 27 can be referred to.

Any of various heat developing apparatus can be employed for photographic processing of the photographic materials of the present invention. Examples of suitable apparatus are described in JP-A-59-75247, JP-A-59-177547, JP-A-59-181353, JP-A-60-18951, and JP-A-U-62-25944 (the term "JP-A-U" as used herein means an "unexamined published Japanese utility model application").

The present invention is now illustrated in greater detail by way of Examples, but it should be understood that the present invention is not deemed to be limited thereto. In Examples, all the parts, percents, and ratios are by weight unless otherwise indicated.

EXAMPLE 1

Preparation of Emulsion (I)

A gelatin aqueous solution was prepared from 800 ml of water, 20 g of gelatin, 1 g of potassium bromide, and 0.5 g of $OH(CH_2)_2S(CH_2)_2OH$, and the solution was kept at 50° C. with stirring. Solutions (I), (II), and (III) shown below were simultaneously added to the gelatin aqueous solution at constant flow rates over 30 minutes to prepare a mono-dispersed silver bromide emulsion having a mean grain size of 0.42 μm in which Dyes (a) and (b) were adsorbed onto silver halide grains.

After washing with water and desalting, 20 g of lime-processed osseous gelatin was added thereto, and the emulsion was adjusted to a pH of 6.4 and a pAg of 8.2. The emulsion was kept at 60° C., and 9 mg of sodium thiosulfate, 6 ml of a 0.01% aqueous solution of chloroauric acid, and 190 mg of 4-hydroxy-6-methyl-1,3,3a,7-tetraazaindene were added thereto to conduct chemical sensitization for 45 minutes to obtain 635 g of an emulsion for a 1st layer [designated Emulsion (I)].

Preparation of Emulsion (II),

An aqueous gelatin solution was prepared from 730 ml of water, 20 g of gelatin, 0.30 g of potassium bromide, 6 g of sodium chloride, and 0.015 g of Compound (A) shown below, and the solution was kept at 60.0° C. under stirring. To the gelatin aqueous solution were added simultaneously Solutions (I) and (II) shown below at constant flow rates over 60 minutes. After the addition of Solutions (I) and (II), Solution (III) [a methanol solution of Sensitizing Dye (c)] was added thereto to obtain a mono-dispersed cubic grain emulsion having a mean grain size of 0.45 μm in which Dye (c) was adsorbed onto the silver halide grains.

After washing with water and desalting, 20 g of gelatin was added to the emulsion, and the emulsion was adjusted to a pH of 6.4 and a pAg of 7.8 The emulsion was then chemically sensitized with 1.6 mg of triethylthiourea and 100 mg of 4-hydroxy-6-methyl-1,3,3a,7-tetraazaindene at 60.0° C. for 55 minutes to obtain 635 g of an emulsion for a 3rd layer [designated Emulsion (II)].

Compound (A):

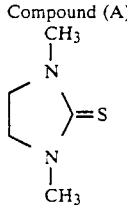

Dye (c):

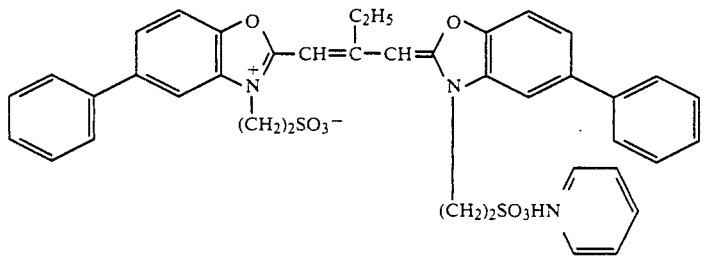

| | Solution I (water added to make 450 ml) | Solution II (water added to make 400 ml) | Solution III (methanol added to make 60 ml) |
|---|---|---|---|
| $AgNO_3$ | 100 g | — | — |
| KBr | — | 70 g | — |
| Dye (a) | — | — | 40 mg |
| Dye (b) | — | — | 80 mg |

Dye (a):

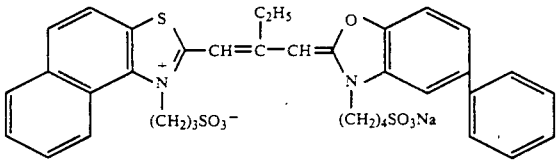

Dye (b):

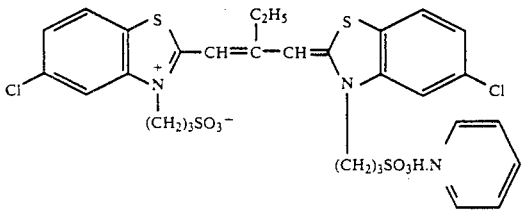

| | Solution I (water added to make 400 ml) | Solution II (water added to make 400 ml) | Solution III (methanol added to make 77 ml) |
|---|---|---|---|
| $AgNO_3$ | 100.0 g | — | — |
| KBr | — | 56.0 g | — |
| NaCl | — | 7.2 g | — |
| Dye (c) | — | — | 0.23 g |

Preparation of Emulsion (III)

A gelatin aqueous solution was prepared from 800 ml of water, 20 g of gelatin, 3 g of potassium bromide, and 0.3 g of $HO(CH_2)_2S(CH_2)_2S(CH_2)_2OH$, and the solution was kept at 55° C. under stirring. To the gelatin aqueous solution were simultaneously added Solutions (1) and (2) shown below over a period of 30 minutes, and then Solutions (3) and (4) shown below were simultaneously added thereto over a period of 20 minutes. After 5 minutes from the start of addition of Solutions (3) and (4), a dye solution shown below was added thereto over 18 minutes.

After washing with water and desalting, 20 g of lime-processed osseous gelatin was added to the emulsion, and the emulsion was adjusted to a pH of 6.2 and a pAg of 8.5. The emulsion was subjected to optimum chemical sensitization with sodium thiosulfate, 4-hydroxy-6-methyl-1,3,3a,7-tetraazaindene, and chloroauric acid to obtain 600 g of a mono-dispersed tetradecahedral silver iodobromide emulsion having a mean grain size of 0.40 μm for a 5th layer [designated Emulsion (III)].

| | Solution (1) (water added to make 180 ml) | Solution (2) (water added to make 180 ml) | Solution (3) (water added to make 350 ml) | Solution (4) (water added make 350 ml) |
|---|---|---|---|---|
| $AgNO_3$ | 30 g | — | 70 g | — |
| KBr | — | 20 g | — | 49 g |
| KI | — | 1.8 g | — | — |

Dye Solution

A solution of 160 ml of methanol having dissolved therein 0.12 g each of the following compounds:

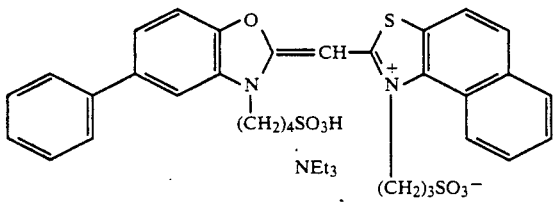

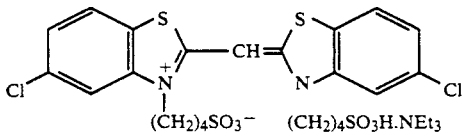

Preparation of Dye Providing Substance Dispersion

A mixture of 20 g of a yellow dye providing substance (1), 13.6 g of an electron donor (1), and 10 g of tricyclohexyl phosphate were dissolved in 57 ml of ethyl acetate under heating at about 60° C. to form a uniform solution. The resulting solution was mixed with 110 g of a 10% aqueous solution of lime-processed gelatin, 65 ml of water, and 1.7 g of sodium dodecylbenzenesulfonate by stirring, and the mixture was dispersed in a homogenizer at 10,000 rpm for 10 minutes to prepare a gelatin dispersion of a yellow dye providing substance.

A dispersion of a magenta or cyan dye providing substance was prepared in the same manner as described above, but using a magenta dye providing substance (2) or a cyan dye providing substance (3), respectively, in place of the yellow dye providing substance.

A multi-layer color photosensitive material having the following layer structure was prepared by using the above prepared silver halide emulsions and dye providing substance dispersions. The resulting photosensitive material was designated Sample 101.

| | |
|---|---|
| Layer Structure: | |
| 6th Layer (Protective Layer): | |
| Gelatin | 0.92 $g/m^2$ |
| $Zn(OH)_2$ | 0.46 $g/m^2$ |
| Matting agent (silica) | 0.03 $g/m^2$ |
| Water-soluble polymer (1) | 0.02 $g/m^2$ |
| Surface active agent (1) | 0.06 $g/m^2$ |
| Surface active agent (2) | 0.13 $g/m^2$ |
| Hardening agent (1) | 0.01 $g/m^2$ |
| 5th Layer (Blue-Sensitive Layer): | |
| Emulsion (III) | 0.35 g of $Ag/m^2$ |
| Gelatin | 0.48 $g/m^2$ |
| $Zn(OH)_2$ | 0.35 $g/m^2$ |
| Antifoggant (1) | $5.00 \times 10^{-4}$ $g/m^2$ |
| Yellow dye providing substance (1) | 0.41 $g/m^2$ |
| High-boiling organic solvent (1) | 0.21 $g/m^2$ |
| Electron donor (1) | 0.25 $g/m^2$ |
| Surface active agent (3) | 0.05 $g/m^2$ |
| Hardening agent (1) | 0.004 $g/m^2$ |
| Water-soluble polymer (1) | 0.01 $g/m^2$ |
| 4th Layer (Interlayer): | |
| Gelatin | 0.70 $g/m^2$ |
| Surface active agent (1) | 0.02 $g/m^2$ |
| Surface active agent (3) | 0.01 $g/m^2$ |
| Water-soluble polymer (1) | 0.02 $g/m^2$ |
| Electron transfer agent (1) | 0.04 $g/m^2$ |
| Reducing agent (1) | 0.13 $g/m^2$ |
| High-boiling organic solvent (1) | 0.05 $g/m^2$ |
| Hardening agent (1) | 0.008 $g/m^2$ |
| 3rd Layer (Green-Sensitive Layer): | |
| Emulsion (II) | 0.21 g of $Ag/m^2$ |
| Gelatin | 0.30 $g/m^2$ |
| Antifoggant (1) | $6.4 \times 10^{-4}$ $g/m^2$ |
| Magenta dye providing substance (2) | 0.29 $g/m^2$ |
| High-boiling organic solvent (1) | 0.15 $g/m^2$ |
| Electron donor (1) | 0.12 $g/m^2$ |

-continued

| | |
|---|---|
| Surface active agent (3) | 0.03 g/m$^2$ |
| Electron transfer agent (1) | 0.03 g/m$^2$ |
| Hardening agent (1) | 0.003 g/m$^2$ |
| Water-soluble polymer (1) | 0.01 g/m$^2$ |
| 2nd Layer (Interlayer): | |
| Gelatin | 0.79 g/m$^2$ |
| $Zn(OH)_2$ | 0.46 g/m$^2$ |
| Surface active agent (1) | 0.02 g/m$^2$ |
| Surface active agent (3) | 0.01 g/m$^2$ |
| Water-soluble polymer (1) | 0.03 g/m$^2$ |
| Activated carbon (1) | 0.25 g/m$^2$ |
| Reducing agent (1) | 0.13 g/m$^2$ |
| High-boiling organic solvent (1) | 0.05 g/m$^2$ |
| Hardening agent (1) | 0.009 g/m$^2$ |
| 1st Layer (Red-Sensitive Layer): | |
| Emulsion (I) | 0.21 g of Ag/m$^2$ |
| Gelatin | 0.30 g/m$^2$ |
| Antifoggant (2) | $6.4 \times 10^{-4}$ g/m$^2$ |
| Cyan dye providing substance (3) | 0.32 g/m$^2$ |
| High-boiling organic solvent (1) | 0.16 g/m$^2$ |
| Electron donor (1) | 0.16 g/m$^2$ |
| Surface active agent (3) | 0.03 g/m$^2$ |
| Electron transfer agent (1) | 0.03 g/m$^2$ |
| Hardening agent (1) | 0.003 g/m$^2$ |
| Water-soluble polymer (1) | 0.01 g/m$^2$ |
| Support: | |
| Polyethylene terephthalate film (thickness: 100 μm) | |
| Backing Layer: | |
| Carbon black | 0.44 g/m$^2$ |
| Polyester | 0.30 g/m$^2$ |
| Polyvinyl chloride | 0.30 g/m$^2$ |

Compounds used in sample preparation were as follows.

Water-Soluble Polymer (1):

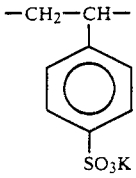

Surface Active Agent (1):

Aerosol ® OT

Surface Active Agent (2):

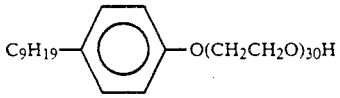

Surface Active Agent (3):

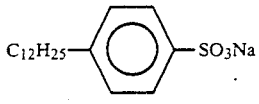

Yellow Dye Providing Substance (1):

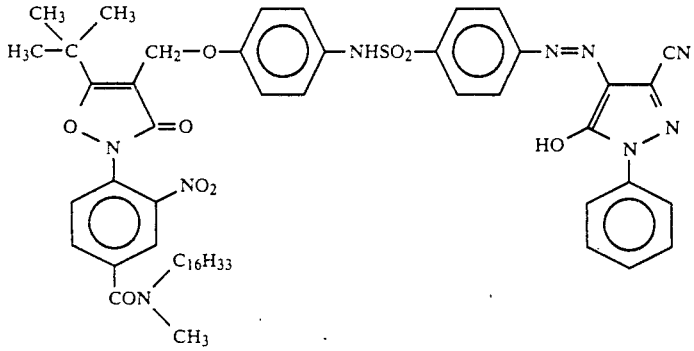

Magenta Dye Providing Substance (2):

-continued
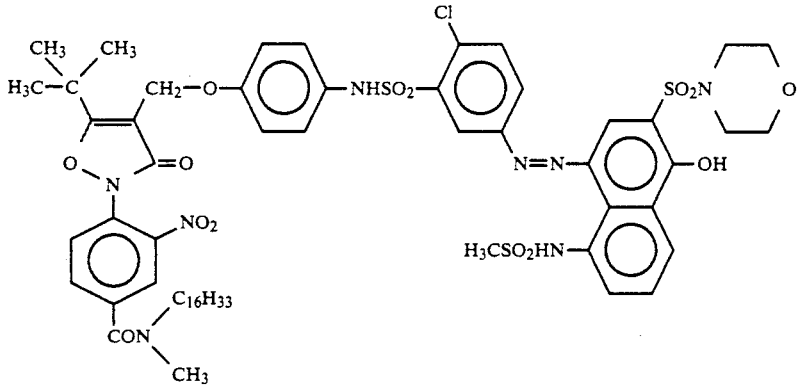
Cyan Dye Providing Substance (3):
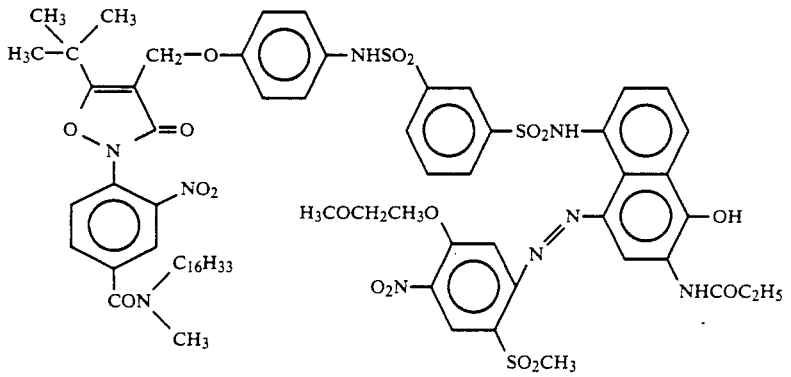
Electron Donor (1):
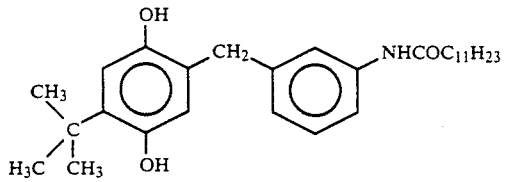
Hardening Agent (1):
1,2-Bis(vinylsulfonylacetamido)ethane
High-Boiling Organic Solvent (1):
Tricyclohexyl phosphate
Activated Carbon (1):
Kyorhoku Shirasagi ®, produced by Takeda Chemical Industries, Ltd.
Antifoggant (1):
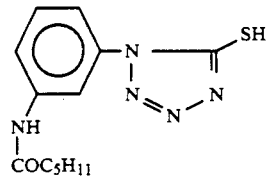
Antifoggant (2):
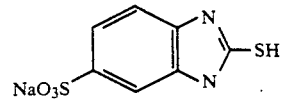
Reducing Agent (1):

-continued

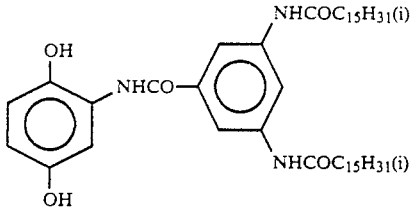

Electron Transfer Agent (1):

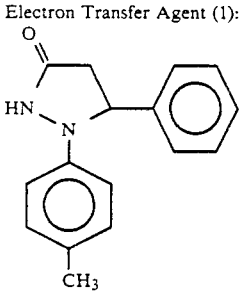

Preparation of Dye Fixing Material

Dye Fixing Material R-1 having the following layer structure was prepared.

| Layer Structure of R-1: | |
|---|---|
| 3rd Layer: | |
| Gelatin | 0.05 g/m$^2$ |
| Silicone oil (1) | 0.04 g/m$^2$ |
| Surface active agent (4) | 0.001 g/m$^2$ |
| Surface active agent (5) | 0.02 g/m$^2$ |
| Surface active agent (6) | 0.10 g/m$^2$ |
| Matting agent (1) | 0.02 g/m$^2$ |
| Guanidine picolinate | 0.45 g/m$^2$ |
| Water-soluble polymer (2) | 0.24 g/m$^2$ |
| 2nd Layer: | |
| Mordant (1) | 2.35 g/m$^2$ |
| Water-soluble polymer (2) | 0.20 g/m$^2$ |
| Gelatin | 1.40 g/m$^2$ |
| Water-soluble polymer (3) | 0.60 g/m$^2$ |
| High-boiling organic solvent (2) | 1.40 g/m$^2$ |
| Guanidine picolinate | 2.25 g/m$^2$ |
| Fluorescent brightening agent (1) | 0.05 g/m$^2$ |
| Surface active agent (8) | 0.15 g/m$^2$ |
| 1st Layer: | |
| Gelatin | 0.45 g/m$^2$ |
| Surface active agent (6) | 0.01 g/m$^2$ |
| Water-soluble polymer (2) | 0.04 g/m$^2$ |
| Hardening agent (2) | 0.30 g/m$^2$ |
| Support (1): | |
| 1st Backing Layer: | |
| Gelatin | 3.25 g/m$^2$ |
| Hardening agent (2) | 0.25 g/m$^2$ |
| 2nd Backing Layer: | |
| Gelatin | 0.44 g/m$^2$ |
| Silicone oil (1) | 0.08 g/m$^2$ |
| Surface active agent (7) | 0.04 g/m$^2$ |
| Surface active agent (8) | 0.01 g/m$^2$ |
| Matting agent (2) | 0.03 g/m$^2$ |

Structure of Support (1):

| Layer | Composition | Film Thickness (μm) |
|---|---|---|
| Surface subbing layer | Gelatin | 0.1 |
| Surface PE layer (glossy) | Low-density polyethylene (density: 0.923): 89.2 parts<br>Surface-treated titanium oxide: 10.0 parts<br>Ultramarine: 0.8 part | 45.0 |

-continued

| | | |
|---|---|---|
| Pulp layer | Wood-free paper (LBKP/NBKP = 1:1; density: 1.080) | 96.2 |
| Back PE layer (matte) | High-density polyethylene (density: 0.960) | 36.0 |
| Back subbing layer | Gelatin | 0.05 |
| | Colloidal silica | 0.05 |
| | Total: | 173.8 |

Compounds used in sample preparation were as follows.

Silicone Oil (1):

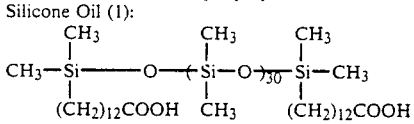

Surface Active Agent (4):

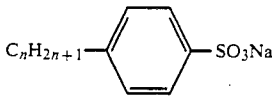

(n: about 12.6)

Surface Active Agent (5):

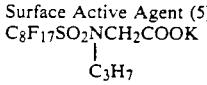

Surface Active Agent (6):

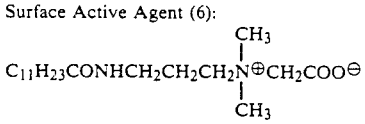

Surface Active Agent (7):

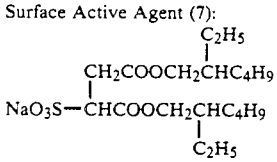

Fluorescent Brightening Agent (1):
2,5-Bis(5-t-butylbenzoxazole(2))thiophene
Surface Active Agent (8):

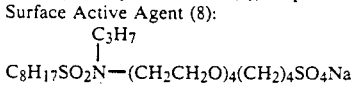

Water-Soluble Polymer (2):
Sumikagel ® L5-H, produced by Sumitomo Chemical Co., Ltd.
Water-Soluble Polymer (3):
Dextran (molecular weight: 70,000)
Mordant (1):

-continued

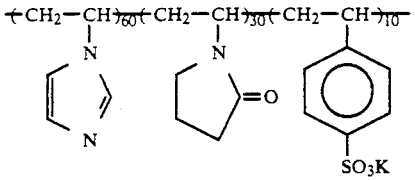

High-boiling Organic Solvent (2):

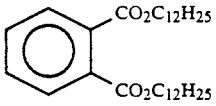

Hardening Agent (2):

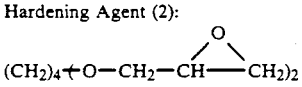

Matting Agent (1):
Silica
Matting Agent (2):
Benzoguanamine resin (average particle size: 15 μm)

Samples 102 to 110 were prepared in the same manner as for Sample 101, except that the additive compound shown in Table 1 below was added to one or more layers shown.

TABLE 1

| Sample No. | Additive | Layer(s) and Amount of Additive (g/m²) 1 | 2 | 3 | 4 | 5 | 6 | Remark |
|---|---|---|---|---|---|---|---|---|
| 101 | none | — | — | — | — | — | — | Comparison |
| 102 | TEG*1 | 0.15 | — | 0.15 | — | 0.15 | — | Comparison |
| 103 | PVP*2 | 0.16 | — | 0.16 | — | 0.16 | — | Comparison |
| 104 | DBA*3 | — | 0.15 | — | 0.15 | — | 0.15 | Comparison |
| 105 | lactose | 0.16 | — | 0.16 | — | 0.16 | — | Invention |
| 106 | " | — | — | — | 0.50 | — | — | " |
| 107 | glucose | 0.15 | — | 0.15 | — | 0.15 | — | " |
| 108 | " | — | 0.15 | — | 0.15 | — | 0.15 | " |
| 109 | fructose | — | 0.50 | — | — | — | — | " |
| 110 | " | — | — | — | — | — | 0.50 | " |

Note:
*1Tetraethylene glycol
*2Polyvinylpyrrolidone (molecular weight: 100,000)

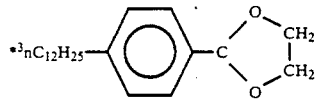

A set of Samples 101 to 110 was preserved under conditions of 45° C. and 70% humidity for 7 days (designated Set B), and another set of Samples 101 to 110 was not preserved under such conditions (designated Set A). The same preservation conditions and the designation of samples will also be applied to Examples hereinafter described.

Each of Samples 101 to 110 of both Sets A and B was exposed to light of a tungsten lamp (500 lux) for 1/10 second through a B, G, R, or gray color separation filter having a continuously varying density. The exposed sample was forwarded on a line at a linear speed of 20 mm/sec while supplying water to the emulsion surface thereof at a rate of 15 ml/m² and, immediately thereafter, Dye fixing Material R-1 was superposed thereon in such a manner that the coated surfaces faced to each other.

The film unit was heated for 15 seconds by means of a heat roller set at such a temperature that the film having absorbed water was heated to 85° C. The photosensitive material was then stripped off the dye fixing material to thereby obtain a clear and even blue, green, red, or gray image, respectively, on the dye fixing material.

The maximum density ($D_{max}$) and the minimum density ($D_{min}$) of the gray part for each of the cyan, magenta, and yellow colors were measured. The results obtained are shown in Table 2.

TABLE 2

| Set | Sample No. | $D_{max}$ Cyan | Magenta | Yellow | $D_{min}$ Cyan | Magenta | Yellow | Remark |
|---|---|---|---|---|---|---|---|---|
| A | 101 | 2.01 | 2.21 | 2.01 | 0.13 | 0.17 | 0.14 | Comparison |
| A | 102 | 2.02 | 2.22 | 2.01 | 0.13 | 0.17 | 0.14 | " |
| A | 103 | 2.02 | 2.21 | 2.00 | 0.13 | 0.17 | 0.14 | " |
| A | 104 | 2.01 | 2.22 | 2.00 | 0.12 | 0.17 | 0.14 | " |
| A | 105 | 2.03 | 2.21 | 2.00 | 0.13 | 0.17 | 0.14 | Invention |
| A | 106 | 2.02 | 2.22 | 2.01 | 0.13 | 0.16 | 0.14 | " |
| A | 107 | 2.02 | 2.21 | 2.01 | 0.12 | 0.17 | 0.13 | " |
| A | 108 | 2.02 | 2.22 | 2.02 | 0.13 | 0.16 | 0.14 | " |
| A | 109 | 2.03 | 2.21 | 2.01 | 0.13 | 0.17 | 0.14 | " |
| A | 110 | 2.02 | 2.22 | 2.01 | 0.12 | 0.17 | 0.14 | " |
| B | 101 | 2.01 | 2.02 | 2.01 | 0.20 | 0.24 | 0.21 | Comparison |
| B | 102 | 2.02 | 2.22 | 2.00 | 0.20 | 0.23 | 0.21 | " |
| B | 103 | 2.01 | 2.21 | 2.01 | 0.21 | 0.24 | 0.21 | " |
| B | 104 | 2.02 | 2.22 | 2.00 | 0.20 | 0.24 | 0.20 | " |
| B | 105 | 2.01 | 2.21 | 2.01 | 0.16 | 0.20 | 0.17 | Invention |
| B | 106 | 2.02 | 2.22 | 2.01 | 0.16 | 0.20 | 0.16 | " |
| B | 107 | 2.01 | 2.21 | 2.01 | 0.17 | 0.20 | 0.17 | " |
| B | 108 | 2.03 | 2.22 | 2.00 | 0.17 | 0.20 | 0.16 | " |
| B | 109 | 2.01 | 2.21 | 2.01 | 0.17 | 0.21 | 0.16 | " |
| B | 110 | 2.02 | 2.22 | 2.01 | 0.16 | 0.20 | 0.17 | " |

As is apparent from the results of Table 2, when preserved for accelerated deterioration, Samples 105 to 110 according to the present invention have lower $D_{min}$ than those of comparative samples.

EXAMPLE 2

A multi-layer color photosensitive material having the following layer structure (Sample 201) was prepared by using the same emulsions, dye providing substances, electron donors, and electron transfer agents as used in Sample 101 of Example 1. Other additives were the same as in Sample 101 unless otherwise specified.

The organic silver salt emulsion used in the same preparation was prepared as follows.

In 1000 ml/of a 0.1% sodium hydroxide aqueous solution and 200 ml of ethanol were dissolved 20 g of gelatin and 5.9 g of 4-acetylaminophenylpropiolic acid, and the solution was kept at 40° C. while stirring. To the solution was added a solution of 4.5 g of silver nitrate in 200 ml of water over a period of 5 minutes. After removing an excess salt by a flocculation method, a pH was adjusted to 6.3 to obtain 300 g of an organic silver salt emulsion.

| | |
|---|---|
| Layer Structure: | |
| 6th Layer (protective Layer): | |
| Gelatin | 0.91 g/m$^2$ |
| Matting agent (silica) | 0.03 g/m$^2$ |
| Surface active agent (1) | 0.06 g/m$^2$ |
| Surface active agent (2) | 0.13 g/m$^2$ |
| Hardening agent (1) | 0.01 g/m$^2$ |
| Base precursor (1) | 0.30 g/m$^2$ |
| 5th Layer (Blue-Sensitive Layer): | |
| Emulsion (III) | 0.30 g of Ag/m$^2$ |
| Organic silver salt emulsion | 0.25 g of Ag/m$^2$ |
| Gelatin | 1.00 g/m$^2$ |
| Antifoggant (1) | 4.00 × 10$^{-4}$ g/m$^2$ |
| Yellow dye providing substance (1) | 0.50 g/m$^2$ |
| High-boiling organic solvent (1) | 0.75 g/m$^2$ |
| Electron donor (2) | 0.20 g/m$^2$ |
| Surface active agent (3) | 0.05 g/m$^2$ |
| Electron transfer agent (2) | 0.04 g/m$^2$ |
| Electron transfer agent precursor (1) | 0.02 g/m$^2$ |
| Thermal solvent (1) | 0.20 g/m$^2$ |
| Hardening agent (1) | 0.01 g/m$^2$ |
| Base precursor (1) | 0.27 g/m$^2$ |
| Water-soluble polymer (1) | 0.02 g/m$^2$ |
| 4th Layer (Interlayer): | |
| Gelatin | 0.75 g/m$^2$ |
| Reducing agent (2) | 0.24 g/m$^2$ |
| Surface active agent (1) | 0.02 g/m$^2$ |
| Surface active agent (4) | 0.07 g/m$^2$ |
| Water-soluble polymer (1) | 0.02 g/m$^2$ |
| Hardening agent (1) | 0.01 g/m$^2$ |
| Base precursor (1) | 0.25 g/m$^2$ |
| 3rd Layer (Green-Sensitive Layer): | |
| Emulsion (II) | 0.20 g of Ag/m$^2$ |
| Organic silver salt emulsion | 0.20 g of Ag/m$^2$ |
| Gelatin | 0.85 g/m$^2$ |
| Antifoggant (1) | 4.50 × 10$^{-4}$ g/m$^2$ |
| Magenta dye providing substance (2) | 0.37 g/m$^2$ |
| High boiling organic solvent (1) | 0.55 g/m$^2$ |
| Electron donor (2) | 0.10 g/m$^2$ |
| Surface active agent (3) | 0.04 g/m$^2$ |
| Electron transfer agent (2) | 0.04 g/m$^2$ |
| Electron transfer agent precursor (1) | 0.02 g/m$^2$ |
| Thermal solvent (1) | 0.16 g/m$^2$ |
| Hardening agent (1) | 0.01 g/m$^2$ |
| Base precursor (1) | 0.25 g/m$^2$ |
| Water-soluble polymer (1) | 0.02 g/m$^2$ |
| 2nd Layer (Interlayer): | |
| Gelatin | 0.80 g/m$^2$ |
| Reducing agent (2) | 0.24 g/m$^2$ |
| Surface active agent (1) | 0.06 g/m$^2$ |
| Surface active agent (4) | 0.10 g/m$^2$ |
| Water-soluble polymer (1) | 0.03 g/m$^2$ |
| Base precursor (1) | 0.25 g/m$^2$ |
| Hardening agent (1) | 0.01 g/m$^2$ |
| 1st Layer (Red-Sensitive Layer): | |
| Emulsion (I) | 0.20 g of Ag/m$^2$ |
| Organic silver salt emulsion | 0.20 g of Ag/m$^2$ |

-continued

| | |
|---|---|
| Gelatin | 0.85 g/m$^2$ |
| Antifoggant (1) | 6.0 × 10$^{-4}$ g/m$^2$ |
| Thermal solvent (1) | 0.16 g/m$^2$ |
| Base precursor (1) | 0.25 g/m$^2$ |
| Cyan dye providing substance (3) | 0.40 g/m$^2$ |
| High-boiling organic solvent (1) | 0.60 g/m$^2$ |
| Electron donor (2) | 0.12 g/m$^2$ |
| Surface active agent (3) | 0.04 g/m$^2$ |
| Electron transfer agent (2) | 0.04 g/m$^2$ |
| Electron transfer agent precursor (1) | 0.02 g/m$^2$ |
| Hardening agent (1) | 0.01 g/m$^2$ |
| Water-soluble polymer (1) | 0.02 g/m$^2$ |
| Support: | |
| Polyethylene terephthalate film (thickness: 100 μm) | |
| Backing Layer: | |
| Carbon black | 0.44 g/m$^2$ |
| Polyester | 0.30 g/m$^2$ |
| Polyvinyl chloride | 0.30 g/m$^2$ |

Compounds used in the sample preparation were as follows.

Electron Donor (2):

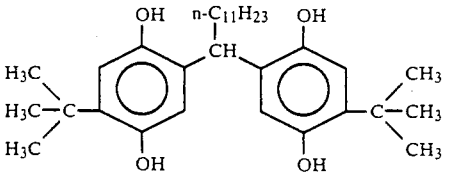

Electron Transfer Agent (2):

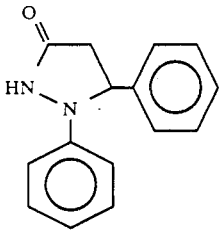

Electron Transfer Agent Precursor (1):

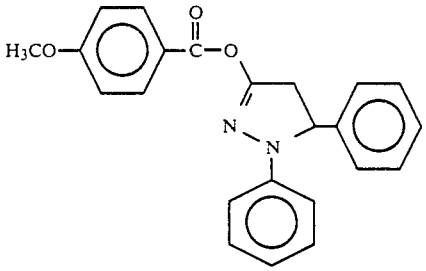

Thermal Solvent (1):

Benzenesulfonamide

Base Precursor (1):

Guanidine 4-chlorophenylsulfonylacetate

Reducing Agent (2):

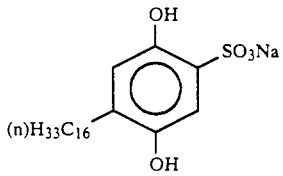

Surface Active Agent (9):

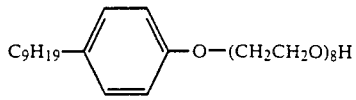

Dye Fixing Material (R-2) was prepared as follows.

Ten grams of poly(methyl acrylate-co-N,N,N-trimethyl-N-vinylbenzylammonium chloride copolymer (ratio of methyl acrylate to vinylbenzylammonium chloride: 1/1) were dissolved in 200 ml of water, and the solution was uniformly mixed with 100 g of a 10% aqueous solution of lime-processed gelatin. A hardening agent was added to the mixture to prepare a coating composition. The coating composition was uniformly coated on a paper support laminated with polyethylene having dispersed therein titanium dioxide to a wet thickness of 90 μm and dried to obtain Dye Fixing Material (R-2) having a mordanted layer.

Samples 202 to 207 were prepared in the same manner as for Sample 201, except that the additive shown in Table 3 below was added to one or more layers shown.

TABLE 3

| Sample No. | Additive | Layer(s) and Amount of Additive ($g/m^2$) 1 | 2 | 3 | 4 | 5 | 6 | Remark |
|---|---|---|---|---|---|---|---|---|
| 201 | none | — | — | — | — | — | — | Comparison |
| 202 | PHEMA*1 | 0.10 | — | 0.10 | — | 0.10 | — | " |
| 203 | PEO*2 | — | 0.10 | — | 0.10 | — | 0.10 | " |
| 204 | sucrose | 0.10 | — | 0.10 | — | 0.10 | — | Invention |
| 205 | " | — | — | — | 0.30 | — | — | " |
| 206 | lactose | — | 0.10 | — | 0.10 | — | 0.10 | " |
| 207 | " | 0.08 | — | 0.08 | — | 0.14 | — | " |

Note:

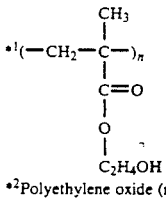

*1 (molecular weight: 200,000)

*2Polyethylene oxide (molecular weight: 200,000)

In the same manner as in Example 1, a set of Samples 201 to 207 (Set B) was preserved at 45° C. and 70% humidity for 7 days.

Each of the samples of both Sets A and B was exposed to light and then uniformly heated on a heat block heated to 140° C. for 30 seconds.

After supplying 20 $ml/m^2$ of water to the coated surface of Dye Fixing Material (R-2), the heated photosensitive material was brought into contact with (R-2) in such a manner that the coated surfaces faced to each other.

The film unit was passed through a laminator heated at 80° C. at a linear speed of 12 mm/sec, and the both films were stripped from each other. There was obtained a positive image of satisfactory discrimination on each of the photosensitive material and the dye fixing material.

$D_{max}$ and $D_{min}$ of the gray part for each of cyan, magenta, and yellow colors were measured. The results obtained are shown in Table 4 below.

TABLE 4

| Set | Sample No. | $D_{max}$ Cyan | Magenta | Yellow | $D_{min}$ Cyan | Magenta | Yellow | Remark |
|---|---|---|---|---|---|---|---|---|
| A | 201 | 2.10 | 2.15 | 2.05 | 0.17 | 0.19 | 0.19 | Comparison |
| A | 202 | 2.10 | 2.13 | 2.04 | 0.17 | 0.20 | 0.19 | " |
| A | 203 | 2.11 | 2.15 | 2.05 | 0.18 | 0.19 | 0.19 | " |
| A | 204 | 2.11 | 2.14 | 2.05 | 0.18 | 0.19 | 0.19 | Invention |
| A | 205 | 2.11 | 2.14 | 2.05 | 0.18 | 0.19 | 0.18 | " |
| A | 206 | 2.10 | 2.15 | 2.05 | 0.17 | 0.19 | 0.19 | " |
| A | 207 | 2.10 | 2.15 | 2.04 | 0.17 | 0.19 | 0.19 | " |
| B | 201 | 2.11 | 2.14 | 2.05 | 0.27 | 0.29 | 0.29 | Comparison |
| B | 202 | 2.10 | 2.15 | 2.04 | 0.27 | 0.28 | 0.29 | " |
| B | 203 | 2.11 | 2.13 | 2.05 | 0.28 | 0.29 | 0.28 | " |
| B | 204 | 2.10 | 2.14 | 2.04 | 0.21 | 0.22 | 0.21 | Invention |
| B | 205 | 2.11 | 2.14 | 2.05 | 0.21 | 0.22 | 0.21 | " |
| B | 206 | 2.10 | 2.14 | 2.05 | 0.22 | 0.23 | 0.21 | " |
| B | 207 | 2.11 | 2.15 | 2.05 | 0.21 | 0.22 | 0.22 | " |

The results of Table 4 clearly demonstrate the effects of the present invention.

EXAMPLE 3

Preparation of Silver Halide Emulsion for 1st and 5th Layers:

A gelatin aqueous solution comprising 1000 ml of water, 20 g of gelatin, and 3 g of sodium chloride was kept at 75° C. while stirring. To the gelatin aqueous solution were added simultaneously 600 ml of an aqueous solution containing sodium chloride and potassium bromide and a silver nitrate aqueous solution containing 0.59 mol of silver nitrate in 600 ml of water at constant flow rates over 40 minutes to prepare a mono-dispersed cubic silver chlorobromide (bromide content: 50 mol%) emulsion having a mean grain size of 0.40 μm.

After washing with water and desalting, 5 mg of sodium thiosulfate and 20 mg of 4-hydroxy-6-methyl-1,3,3a,7-tetraazaindene were added to the emulsion to conduct chemical sensitization at 60° C. The yield of the emulsion was 600 g.

Preparation of Silver Halide Emulsion for 3rd Layer

A gelatin aqueous solution prepared from 1000 ml of water, 20 g of gelatin, and 3 g of sodium chloride was kept at 75° C. while stirring. To the gelatin aqueous solution were added simultaneously 600 ml of an aqueous solution containing sodium chloride and potassium bromide and a silver nitrate aqueous solution containing 0.59 mol of silver nitrate in 600 ml of water at constant flow rates over 40 minutes to prepare a mono-dispersed cubic silver chlorobromide (bromide content: 80 mol%) emulsion having a mean grain size of 0.35 μm.

After washing with water and desalting, 5 mg of sodium thiosulfate and 20 mg of 4-hydroxy-6-methyl-1,3,3a,7-tetraazaindene to the emulsion to conduct chemical sensitization at 60° C. The yield of the emulsion was 600 g.

Preparation of Silver Benzotriazole Emulsion

In 300 ml of water were dissolved 28 g of gelatin and 13.2 g of benzotriazole, and the solution was kept at 40° C. while stirring. A solution of 17 g of silver nitrate in 100 ml of water was added to the gelatin aqueous solution over 2 minutes.

After removing an excess salt by a flocculation method by pH adjustment, the pH of the emulsion was adjusted to 6.30 to obtain 400 g of a silver benzotriazole emulsion.

Preparation of Silver Acetylene Emulsion

In 1000 ml of water and 200 ml of ethanol were dissolved 20 g of gelatin and 4.6 g of 4-acetylaminophenylacetylene, and the solution was kept at 40° C. while stirring. To the solution was added a solution of 4.5 g of silver nitrate in 200 ml of water over 5 minutes. After removing an excess salt by a flocculation method by pH adjustment, the dispersion was adjusted to a pH of 6.3 to obtain 300 g of a silver acetylene compound dispersion.

Preparation of Dye Providing Substance Dispersion

A mixture of 5 g of a yellow dye providing substance (4), 0.2 g of an auxiliary developing agent (i), 0.2 g of an antifoggant (ii) and, as surface active agents, 0.5 g of sodium succinic acid-2-ethylhexyl ester sulfonate and 2.5 g of triisononyl phosphate was dissolved in 30 ml of ethyl acetate under heating to about 60° C. to prepare a uniform solution. The resulting solution was mixed by stirring with 100 g of a 3% aqueous solution of lime-processed gelatin, and the mixture was dispersed in a homogenizer at 10,000 rpm for 10 minutes to obtain a yellow dye providing substance dispersion.

Auxiliary Developing Agent (i):

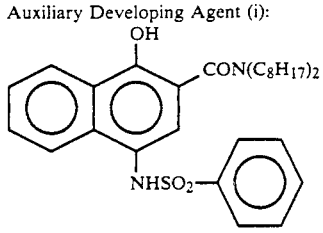

Antifoggant (ii):

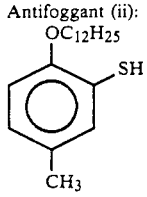

A magenta dye providing substance dispersion was prepared in the same manner as for the yellow dye providing substance dispersion, except for using a magenta dye providing substance (5) in place of the yellow dye providing substance and using 2.5 g of tricresyl phosphate as a high-boiling solvent.

A cyan dye providing substance dispersion was prepared in the same manner as for the yellow dye providing substance dispersion, except for using a cyan dye providing substance (6) in place of the yellow dye providing substance.

A multi-layer heat developable color photosensitive material having the following layer structure was prepared by using the thus prepared emulsions and dispersions. The resulting sample was designated Sample 301.

| Layer Structure: | |
|---|---|
| 6th Layer (Protective Layer): | |
| Gelatin | 800 mg/m$^2$ |
| Hardening agent (1) | 16 mg/m$^2$ |
| Silica (particle size: 4 μm) | 100 mg/m$^2$ |
| Zinc hydroxide (particle size: 0.1 μm) | 300 mg/m$^2$ |
| 5th Layer (Green-Sensitive Layer): | |
| Silver chlorobromide emulsion (bromide content: 50 mol %) | 400 mg of Ag/m$^2$ |
| Silver benzotriazole emulsion | 20 mg of Ag/m$^2$ |
| Sensitizing Dye (D-1) | $10^{-6}$ mol/m$^2$ |
| Hardening agent (1) | 16 mg/m$^2$ |
| Yellow dye providing providing substance (4) | 400 mg/m$^2$ |
| Gelatin | 1400 mg/m$^2$ |
| High-boiling solvent (3) | 200 mg/m$^2$ |
| Surface active agent (9) | 100 mg/m$^2$ |
| 4th layer (Interlayer): | |
| Gelatin | 900 mg/m$^2$ |
| Hardening agent (3) | 18 mg/m$^2$ |
| Zinc hydroxide (particle size: 0.1 μm) | 300 mg/m$^2$ |
| 3rd Layer (Red-Sensitive Layer): | |
| Silver chlorobromide emulsion (bromide content: 80 mol %) | 300 mg of Ag/m$^2$ |
| Silver acetylene emulsion | 60 mg of Ag/m$^2$ |
| Silver benzotriazole emulsion | 20 mg of Ag/m$^2$ |
| Sensitizing dye (D-2) | $8 \times 10^{-7}$ mol/m$^2$ |
| Hardening agent (3) | 18 mg/m$^2$ |
| Magenta dye providing substance (5) | 400 mg/m$^2$ |
| Gelatin | 800 mg/m$^2$ |
| High-boiling solvent (3) | 200 mg/m$^2$ |
| Surface active agent (9) | 100 mg/m$^2$ |

-continued

| Layer Structure: | |
|---|---|
| 2nd Layer (Interlayer): | |
| Gelatin | 800 mg/m$^2$ |
| Hardening agent (1) | 16 mg/m$^2$ |
| Zinc hydroxide (particle size: 0.1 μm) | 300 mg/m$^2$ |
| 1st Layer (Infrared-Sensitive Layer): | |
| Silver chlorobromide emulsion (bromide content: 50 mol %) | 300 mg of Ag/m$^2$ |
| Silver acetylene emulsion | 25 mg of Ag/m$^2$ |
| Silver benzotriazole emulsion | 50 mg of Ag/m$^2$ |
| Sensitizing dye (D-3) | $1 \times 10^{-8}$ mol/m$^2$ |
| Hardening agent (1) | 16 mg/m$^2$ |
| Cyan dye providing substance (6) | 300 mg/m$^2$ |
| Gelatin | 600 mg/m$^2$ |
| High-boiling solvent (3) | 150 mg/m$^2$ |
| Surface active agent (9) | 100 mg/m$^2$ |
| Support: | |
| Polyethylene terephthalate film (thickness: 180 μm) | |

High-Boiling Solvent (3):
$(isoC_9H_{19}O)_3P{=}O$
Yellow Dye Providing Substance (4):

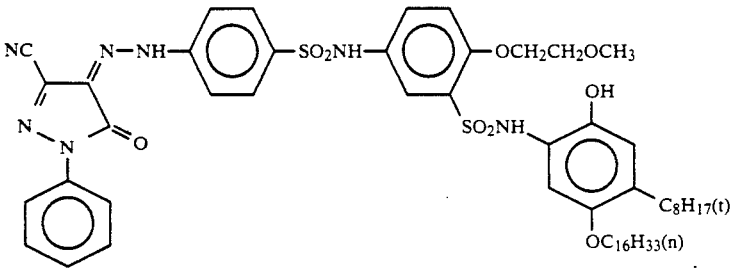

Magenta Dye Providing Substance (5):

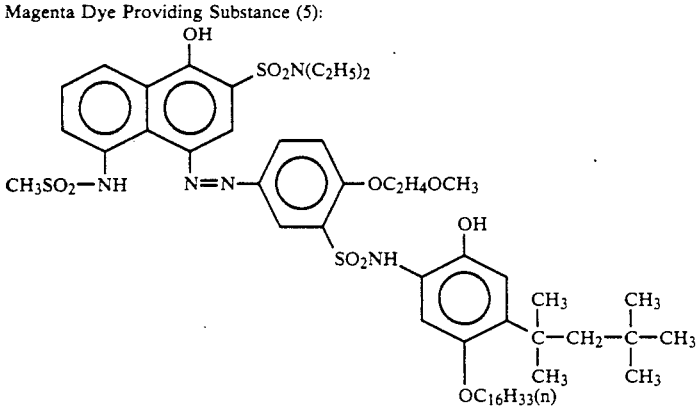

Cyan Dye Providing Substance (6):

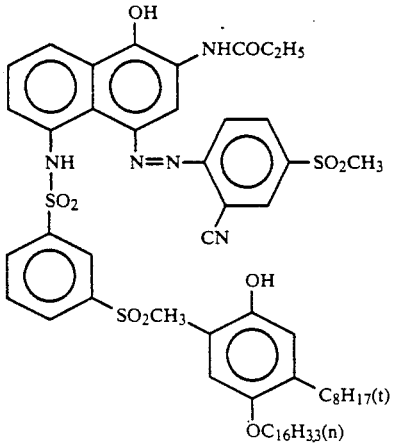

Sensitizing Dye (D-1):

-continued

Layer Structure:

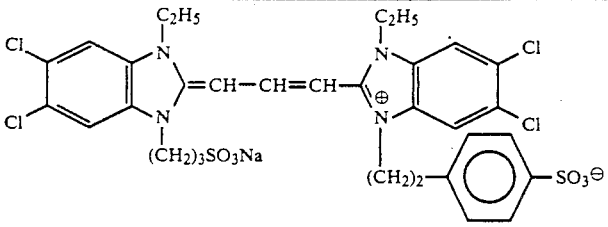

Sensitizing Dye (D-2):

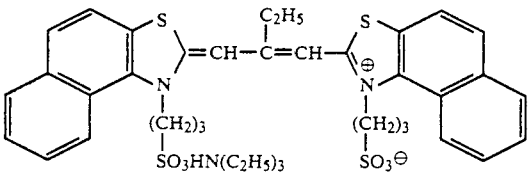

Sensitizing Dye (D-3):

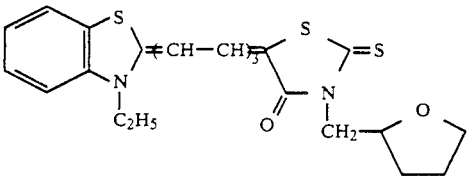

Samples 302 to 309 were prepared in the same manner as for Sample 301, except that the additive shown in Table 5 below was added to one or more layers shown.

TABLE 5

| Sample No. | Additive | Layer(s) and Amount of Additive (g/m²) 1 | 2 | 3 | 4 | 5 | 6 | Remark |
|---|---|---|---|---|---|---|---|---|
| 301 | none | — | — | — | — | — | — | Comparison |
| 302 | PPO* | — | 0.10 | — | 0.20 | — | 0.10 | " |
| 303 | PHEMA | 0.20 | — | 0.10 | — | 0.10 | — | " |
| 304 | lactose | — | 0.13 | — | 0.13 | — | 0.14 | Invention |
| 305 | " | 0.13 | — | 0.13 | — | 0.14 | — | " |
| 306 | maltose | — | — | — | 0.40 | — | — | " |
| 307 | " | — | — | — | — | — | 0.40 | " |
| 308 | galactose | — | 0.20 | — | 0.20 | — | — | " |
| 309 | " | 0.11 | — | 0.11 | — | 0.18 | — | " |

Note:

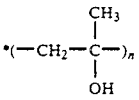

(molecular weight: 200,000)

In the same manner as in Example 1, a set of Samples 301 to 307 (Set B) was preserved at 45° C. and 70% humidity for 7 days.

Each of Samples 301 to 307 of both Sets A and B was exposed to light of a tungsten lamp (500 lux) for 1 second through a G, R, or IR color separation filter having a continuously varying density. The G and R filters were band transmission filter having a transmission wavelength of 500 to 600 nm and 600 to 700 nm, respectively, and the IR filter was a filter having a transmission of 700 nm or more.

Water was supplied to the emulsion surface of the exposed photosensitive material at a rate of 12 ml/m², and the photosensitive material and Dye Fixing Material (R-1) were laminated in such a manner that the coated layers faced to each other.

The film unit was heated for 30 seconds by means of a heat roller set at such a temperature that the film having absorbed water was heated to 93° C., and the dye fixing material was then stripped off the photosensitive material. There were obtained clear yellow, magenta, and cyan images on the dye fixing material in correspondence to the G, R, and IR color separation filters, respectively.

$D_{max}$ and $D_{min}$ of each color were measured. The results obtained are shown in Table 6 below.

TABLE 6

| Set | Sample No. | $D_{max}$ Cyan | Magenta | Yellow | $D_{min}$ Cyan | Magenta | Yellow | Remark |
|---|---|---|---|---|---|---|---|---|
| A | 301 | 2.30 | 2.20 | 2.03 | 0.12 | 0.12 | 0.13 | Comparison |
| A | 302 | 2.31 | 2.21 | 2.04 | 0.13 | 0.12 | 0.12 | " |
| A | 303 | 2.30 | 2.19 | 2.03 | 0.13 | 0.12 | 0.13 | " |

TABLE 6-continued

| Set | Sample No. | $D_{max}$ Cyan | $D_{max}$ Magenta | $D_{max}$ Yellow | $D_{min}$ Cyan | $D_{min}$ Magenta | $D_{min}$ Yellow | Remark |
|---|---|---|---|---|---|---|---|---|
| A | 304 | 2.31 | 2.20 | 2.04 | 0.12 | 0:11 | 0.12 | Invention |
| A | 305 | 2.30 | 2.20 | 2.03 | 0.13 | 0.11 | 0.13 | " |
| A | 306 | 2.31 | 2.20 | 2.04 | 0.12 | 0.12 | 0.12 | " |
| A | 307 | 2.30 | 2.20 | 2.04 | 0.12 | 0.11 | 0.12 | " |
| A | 308 | 2.31 | 2.21 | 2.04 | 0.13 | 0.11 | 0.12 | " |
| A | 309 | 2.30 | 2.20 | 2.03 | 0.12 | 0.12 | 0.12 | " |
| B | 301 | 2.31 | 2.20 | 2.03 | 0.17 | 0.18 | 0.18 | Comparison |
| B | 302 | 2.30 | 2.21 | 2.03 | 0.17 | 0.18 | 0.18 | " |
| B | 303 | 2.31 | 2.20 | 2.04 | 0.17 | 0.18 | 0.17 | " |
| B | 304 | 2.30 | 2.21 | 2.04 | 0.15 | 0.15 | 0.14 | Invention |
| B | 305 | 2.31 | 2.21 | 2.04 | 0.15 | 0.14 | 0.15 | " |
| B | 306 | 2.31 | 2.21 | 2.03 | 0.14 | 0.15 | 0.14 | " |
| B | 307 | 2.30 | 2.21 | 2.04 | 0.15 | 0.14 | 0.14 | " |
| B | 308 | 2.31 | 2.20 | 2.03 | 0.15 | 0.15 | 0.15 | " |
| B | 309 | 2.31 | 2.21 | 2.03 | 0.14 | 0.14 | 0.15 | " |

The results of Table 6 clearly prove the effects of the present invention.

EXAMPLE 4

Preparation of Silver Halide Emulsions:

Emulsions (I), (II), and (III) for 1st, 3rd, and 5th layers were prepared in the same manner as described in Example 1.

Preparation of Dye Providing Substance Dispersion

A mixture of 13 g of a yellow dye providing substance (7), 10.3 g of an electron donor (1), and 6.5 g of tricyclohexyl phosphate were dissolved in 37 ml of ethyl acetate by heating at about 60° C. to form a uniform solution. The resulting solution was mixed with 100 g of a 10% aqueous solution of lime-processed gelatin, 60 ml of water, and 1.5 g of sodium dodecylbenzenesulfonate by stirring, and the mixture was dispersed in a homogenizer at 10,000 rpm for 10 minutes to prepare a dispersion of a yellow dye providing substance.

Magenta and cyan dye providing substance dispersions were prepared in the same manner as described above, except for using a magenta dye providing substance (8) and a cyan dye providing substance (9), respectively.

A multi-layer color photosensitive material having the following layer structure was prepared by using the above prepared emulsions and dispersions. The resulting sample was designated Sample 401.

| Layer Structure: | |
|---|---|
| 6th Layer (Protective Layer): | |
| Gelatin | 0.92 g/m$^2$ |
| $Zn(OH)_2$ | 0.61 g/m$^2$ |
| Matting agent (silica) | 0.03 g/m$^2$ |
| Water-soluble polymer (1) | 0.02 g/m$^2$ |
| Surface active agent (1) | 0.06 g/m$^2$ |
| Surface active agent (2) | 0.13 g/m$^2$ |
| Hardening agent (1) | 0.01 g/m$^2$ |
| 5th Layer (Blue-Sensitive Layer): | |
| Emulsion (III) | 0.35 g of Ag/m$^2$ |
| Gelatin | 0.48 g/m$^2$ |
| Antifoggant (1) | $5.00 \times 10^{-4}$ g/m$^2$ |
| Yellow dye providing substance (7) | 0.41 g/m$^2$ |
| High-boiling organic solvent (1) | 0.21 g/m$^2$ |
| Electron donor (1) | 0.32 g/m$^2$ |
| Surface active agent (3) | 0.05 g/m$^2$ |
| Hardening agent (1) | 0.004 g/m$^2$ |
| Water-soluble polymer (1) | 0.01 g/m$^2$ |
| 4th Layer (Interlayer): | |
| Gelatin | 0.70 g/m$^2$ |
| Surface active agent (1) | 0.02 g/m$^2$ |
| Surface active agent (3) | 0.01 g/m$^2$ |
| Surface active agent (9) | 0.03 g/m$^2$ |
| Water-soluble polymer (1) | 0.02 g/m$^2$ |
| Electron transfer agent (2) | 0.11 g/m$^2$ |
| Reducing agent (1) | 0.13 g/m$^2$ |
| High-boiling organic solvent (1) | 0.05 g/m$^2$ |
| Hardening agent (1) | 0.008 g/m$^2$ |
| 3rd Layer (Green-Sensitive Layer): | |
| Emulsion (II) | 0.21 g of Ag/m$^2$ |
| Gelatin | 0.30 g/m$^2$ |
| Antifoggant (2) | $6.4 \times 10^{-4}$ g/m$^2$ |
| Magenta dye providing substance (8) | 0.31 g/m$^2$ |
| High-boiling organic solvent (1) | 0.15 g/m$^2$ |
| Electron donor (1) | 0.16 g/m$^2$ |
| Surface active agent (3) | 0.03 g/m$^2$ |
| Hardening agent (1) | 0.003 g/m$^2$ |
| Water-soluble polymer (1) | 0.01 g/m$^2$ |
| 2nd Layer (Interlayer): | |

-continued

| Layer Structure: | |
|---|---|
| Gelatin | 0.79 g/m$^2$ |
| $Zn(OH)_2$ | 0.46 g/m$^2$ |
| Surface active agent (1) | 0.02 g/m$^2$ |
| Surface active agent (3) | 0.01 g/m$^2$ |
| Surface active agent (9) | 0.05 g/m$^2$ |
| Water-soluble polymer (1) | 0.03 g/m$^2$ |
| Activated carbon (1) | 0.25 g/m$^2$ |
| Reducing agent (1) | 0.13 g/m$^2$ |
| High-boiling organic solvent (1) | 0.05 g/m$^2$ |
| Hardening agent (1) | 0.009 g/m$^2$ |
| 1st Layer (Red-sensitive Layer): | |
| Emulsion (I) | 0.21 g of Ag/m$^2$ |
| Gelatin | 0.30 g/m$^2$ |
| Antifoggant (2) | $6.4 \times 10^{-4}$ g/m$^2$ |
| Cyan dye providing substance (9) | 0.39 g/m$^2$ |
| High-boiling organic solvent (1) | 0.19 g/m$^2$ |
| Electron donor (1) | 0.19 g/m$^2$ |
| Surface active agent (3) | 0.03 g/m$^2$ |
| Hardening agent (1) | 0.003 g/m$^2$ |
| Water-soluble polymer (1) | 0.01 g/m$^2$ |
| Support: | |
| Polyethylene terephthalate film (thickness: 100 μm) | |
| Backing Layer: | |
| Carbon black | 0.44 g/m$^2$ |
| Polyester | 0.30 g/m$^2$ |
| Polyvinyl chloride | 0.30 g/m$^2$ |

Yellow Dye Providing Substance (7):

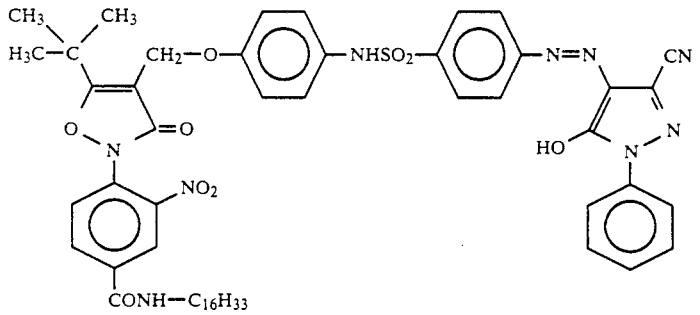

Magenta Dye Providing Substance (8):

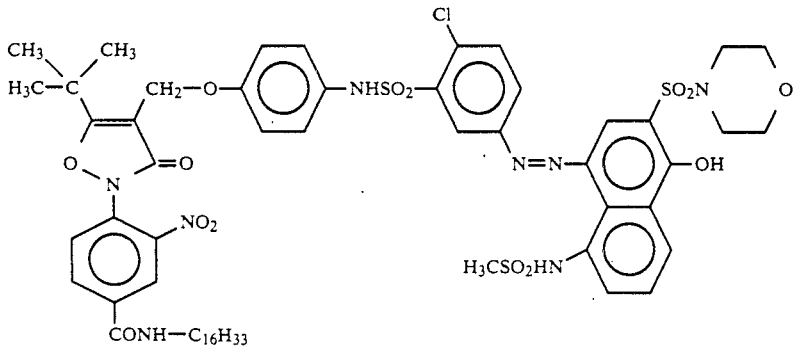

Cyan Dye Providing Substance (9):

-continued

Layer Structure:

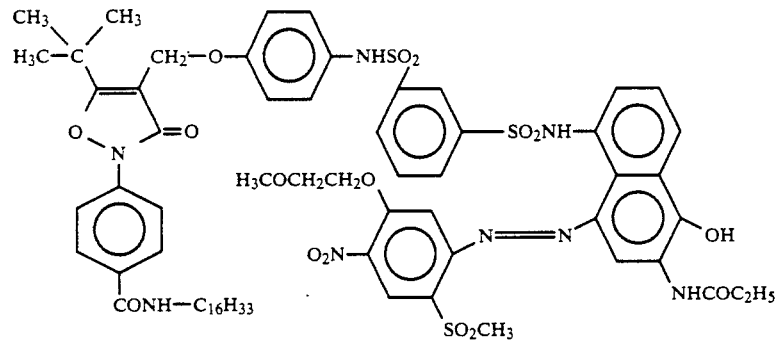

Samples 402 to 410 were prepared in the same manner as for Sample 401, except for adding the additive(s) shown in Table 7 below to one or more layers shown.

TABLE 7

| Sample No. | Additive | Layer(s) and Amount of Additive ($gm^2$) 1 | 2 | 3 | 4 | 5 | 6 | Remark |
|---|---|---|---|---|---|---|---|---|
| 401 | none | — | — | — | — | — | — | Comparison |
| 402 | lactose | 0.15 | — | 0.15 | — | 0.15 | — | " |
| 403 | PVA-120*1 | 0.16 | — | 0.16 | — | 0.16 | — | " |
| 404 | lactose | — | 0.15 | — | 0.15 | — | 0.15 | " |
| 405 | lactose | 0.16 | — | 0.16 | — | 0.16 | — | Invention |
| | PVA-120 | 0.08 | — | 0.08 | — | 0.08 | — | |
| 406 | lactose | — | — | — | 0.50 | — | — | " |
| | PVA-120 | — | 0.08 | — | 0.08 | — | 0.08 | |
| 407 | glucose | 0.15 | — | 0.15 | — | 0.15 | — | " |
| | PVA-120 | 0.08 | — | 0.08 | — | 0.08 | — | |
| 408 | glucose | — | 0.15 | — | 0.15 | — | 0.15 | " |
| | PVA-120 | — | 0.08 | — | 0.08 | — | 0.08 | |
| 409 | fructose | — | 0.05 | — | — | — | — | " |
| | PVA-210*2 | — | — | — | 0.25 | — | — | |
| 410 | fructose | — | — | — | — | — | 0.50 | " |
| | PVA-210 | 0.20 | — | 0.20 | — | 0.20 | — | |

Note:
*1Polyvinyl alcohol having a degree of saponification of 98.5 ± 0.5 mol % and an average degree of polymerization of about 2000 (produced by Kuraray Co., Ltd.)
*2Polyvinyl alcohol having a degree of saponification of 88.0 ± 1.0 mol % and an average degree of polymerization of about 1200 (produced by Kuraray Co., Ltd.)

A set of Samples 401 to 410 (Set B) was preserved at 45° C. and 80% RH for 4 days.

Each of the samples of both Sets A and B was exposed to light of a tungsten lamp (5000 lux) for 1/10 second through a B, G, R, or gray color separation filter having a continuously varying density.

Water was supplied to the emulsion layer of the exposed sample at a rate of 15 ml/$m^2$ with a wire bar, and the emulsion layer was brought into contact with the coated surface of Dye Fixing Material (R-1).

The film unit was heated for 15 seconds by means of a heat roller set at such a temperature that the film having absorbed water was heated to 80° C.

When the photosensitive material was stripped off the dye fixing material, there were obtained clear and even blue, green, red, and gray images in correspondence to the B, G, R, and gray color separation filters, respectively.

$D_{max}$ and $D_{min}$ of the gray part for each of cyan, magenta, and yellow colors were measured. The results obtained are shown in Table 8 below.

TABLE 8

| Set | Sample No. | $D_{max}$ Yellow | Magenta | Cyan | $D_{min}$ Yellow | Magenta | Cyan | Remark |
|---|---|---|---|---|---|---|---|---|
| A | 401 | 2.1 | 2.2 | 2.2 | 0.22 | 0.20 | 0.20 | Comparison |
| A | 402 | 2.1 | 2.2 | 2.1 | 0.19 | 0.18 | 0.17 | " |
| A | 403 | 2.0 | 2.1 | 2.1 | 0.18 | 0.17 | 0.16 | " |
| A | 404 | 2.1 | 2.2 | 2.2 | 0.20 | 0.18 | 0.18 | " |
| A | 405 | 2.0 | 2.1 | 2.1 | 0.13 | 0.14 | 0.12 | Invention |
| A | 406 | 2.0 | 2.2 | 2.1 | 0.14 | 0.14 | 0.13 | " |
| A | 407 | 2.1 | 2.2 | 2.2 | 0.15 | 0.14 | 0.13 | " |
| A | 408 | 2.0 | 2.1 | 2.1 | 0.14 | 0.14 | 0.12 | " |
| A | 409 | 2.1 | 2.2 | 2.2 | 0.15 | 0.15 | 0.13 | " |
| A | 410 | 2.1 | 2.2 | 2.2 | 0.15 | 0.15 | 0.13 | " |
| B | 401 | 2.1 | 2.2 | 2.2 | 0.30 | 0.27 | 0.28 | Comparison |
| B | 402 | 2.1 | 2.2 | 2.1 | 0.24 | 0.22 | 0.22 | " |
| B | 403 | 2.0 | 2.1 | 2.1 | 0.23 | 0.23 | 0.22 | " |
| B | 404 | 2.1 | 2.2 | 2.2 | 0.24 | 0.23 | 0.22 | " |
| B | 405 | 2.1 | 2.1 | 2.1 | 0.16 | 0.16 | 0.13 | Invention |

TABLE 8-continued

| Set | Sample No. | $D_{max}$ Yellow | $D_{max}$ Magenta | $D_{max}$ Cyan | $D_{min}$ Yellow | $D_{min}$ Magenta | $D_{min}$ Cyan | Remark |
|---|---|---|---|---|---|---|---|---|
| B | 406 | 2.0 | 2.2 | 2.1 | 0.17 | 0.17 | 0.15 | " |
| B | 407 | 2.1 | 2.2 | 2.2 | 0.17 | 0.17 | 0.13 | " |
| B | 408 | 2.1 | 2.1 | 2.1 | 0.17 | 0.16 | 0.14 | " |
| B | 409 | 2.1 | 2.1 | 2.2 | 0.18 | 0.17 | 0.15 | " |
| B | 410 | 2.1 | 2.2 | 2.2 | 0.18 | 0.17 | 0.15 | " |

It can be seen from the results of Table 8 that Samples 405 to 410 according to the present invention have lower minimum densities than the comparative samples in both of Sets A and B.

EXAMPLE 5

A multi-layer color photographic material having the following layer structure was prepared by using the same emulsions, dye providing substances, and electron transfer agents as used in Sample 401 of Example 4. Additives used in the sample preparation were the same as those used in Sample 401 unless otherwise specified. The organic silver salt emulsion used in the sample preparation was prepared in the same manner as described in Example 2. The resulting sample was designated Sample 501.

| Layer Structure: | |
|---|---|
| 6th Layer (Protective Layer): | |
| Gelatin | 0.91 g/m$^2$ |
| Matting agent (silica) | 0.03 g/m$^2$ |
| Surface active agent (1) | 0.06 g/m$^2$ |
| Surface active agent (2) | 0.13 g/m$^2$ |
| Hardening agent (1) | 0.01 g/m$^2$ |
| Base precursor (1) | 0.30 g/m$^2$ |
| 5th Layer (Blue-Sensitive Layer): | |
| Emulsion (III) | 0.30 g of Ag/m$^2$ |
| Organic silver salt emulsion | 0.25 g of Ag/m$^2$ |
| Gelatin | 1.00 g/m$^2$ |
| Antifoggant (1) | $8.00 \times 10^{-4}$ g/m$^2$ |
| Yellow dye providing substance (7) | 0.50 g/m$^2$ |
| High-boiling organic solvent (1) | 0.75 g/m$^2$ |
| Electron donor (2) | 0.20 g/m$^2$ |
| Surface active agent (3) | 0.05 g/m$^2$ |
| Electron transfer agent (2) | 0.04 g/m$^2$ |
| Electron transfer agent precursor (1) | 0.04 g/m$^2$ |
| Thermal solvent (1) | 0.20 g/m$^2$ |
| Hardening agent (1) | 0.01 g/m$^2$ |
| Base precursor (1) | 0.27 g/m$^2$ |
| Water-soluble polymer (1) | 0.02 g/m$^2$ |
| 4th Layer (Interlayer): | |
| Gelatin | 0.75 g/m$^2$ |
| Reducing agent (2) | 0.24 g/m$^2$ |
| Surface active agent (1) | 0.02 g/m$^2$ |
| Surface active agent (4) | 0.07 g/m$^2$ |
| Water-soluble polymer (1) | 0.02 g/m$^2$ |
| Hardening agent (1) | 0.01 g/m$^2$ |
| Base precursor (1) | 0.25 g/m$^2$ |
| 3rd Layer (Green-Sensitive Layer): | |
| Emulsion (II) | 0.20 g of Ag/m$^2$ |
| Organic silver salt emulsion | 0.20 g of Ag/m$^2$ |
| Gelatin | 0.85 g/m$^2$ |

-continued

| Layer Structure: | |
|---|---|
| Antifoggant (1) | $7.00 \times 10^{-4}$ g/m$^2$ |
| Magenta dye providing substance (8) | 0.37 g/m$^2$ |
| High-boiling organic solvent (1) | 0.55 g/m$^2$ |
| Electron donor (2) | 0.10 g/m$^2$ |
| Surface active agent (3) | 0.04 g/m$^2$ |
| Electron transfer agent (2) | 0.04 g/m$^2$ |
| Electron transfer agent precursor (1) | 0.04 g/m$^2$ |
| Thermal solvent (1) | 0.16 g/m$^2$ |
| Hardening agent (1) | 0.01 g/m$^2$ |
| Base precursor (1) | 0.25 g/m$^2$ |
| Water-soluble polymer (1) | 0.02 g/m$^2$ |
| 2nd Layer (Interlayer): | |
| Gelatin | 0.80 g/m$^2$ |
| Reducing agent (3) | 0.24 g/m$^2$ |
| Surface active agent (1) | 0.06 g/m$^2$ |
| Surface active agent (4) | 0.10 g/m$^2$ |
| Water-soluble polymer (1) | 0.03 g/m$^2$ |
| Base precursor (1) | 0.25 g/m$^2$ |
| Hardening agent (1) | 0.01 g/m$^2$ |
| 1st Layer (Red-sensitive Layer): | |
| Emulsion (I) | 0.20 g of Ag/m$^2$ |
| Organic silver salt emulsion | 0.20 g of Ag/m$^2$ |
| Gelatin | 0.85 g/m$^2$ |
| Antifoggant (2) | $9.00 \times 10^{-4}$ g/m$^2$ |
| Thermal solvent (1) | 0.16 g/m$^2$ |
| Base precursor (1) | 0.25 g/m$^2$ |
| Cyan dye providing substance (9) | 0.40 g/m$^2$ |
| High-boiling organic solvent (1) | 0.60 g/m$^2$ |
| Electron donor (2) | 0.12 g/m$^2$ |
| Surface active agent (3) | 0.04 g/m$^2$ |
| Electron transfer agent (2) | 0.04 g/m$^2$ |
| Electron transfer agent precursor (1) | 0.04 g/m$^2$ |
| Hardening agent (1) | 0.01 g/m$^2$ |
| Water-soluble polymer (1) | 0.02 g/m$^2$ |
| Support: | |
| Polyethylene terephthalate film (thickness: 100 μm) | |
| Backing Layer: | |
| Carbon black | 0.44 g/m$^2$ |
| Polyester | 0.30 g/m$^2$ |
| Polyvinyl chloride | 0.30 g/m$^2$ |
| Reducing Agent (3): | |

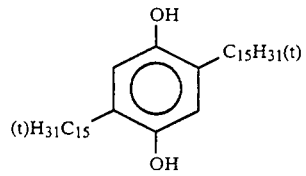

Samples 502 to 507 were prepared in the same manner as for Sample 501, except for adding the additive(s) shown in Table 9 below to one or more layers shown.

TABLE 9

| Sample No. | Additive | Layer(s) and Amount of Additive (gm$^2$) 1 | 2 | 3 | 4 | 5 | 6 | Remark |
|---|---|---|---|---|---|---|---|---|
| 501 | none | — | — | — | — | — | — | Comparison |
| 502 | sucrose | 0.10 | — | 0.10 | — | 0.10 | — | " |
| 503 | PVA-120 | — | 0.10 | — | 0.10 | — | 0.10 | " |
| 504 | sucrose | 0.10 | — | 0.10 | — | 0.10 | — | Invention |
| | PVA-120 | 0.15 | — | 0.15 | — | 0.15 | — | |
| 505 | sucrose | — | — | — | 0.30 | — | — | " |
| | PVA-210 | — | 0.10 | — | 0.10 | — | 0.20 | |

TABLE 9-continued

| Sample No. | Additive | Layer(s) and Amount of Additive ($gm^2$) 1 | 2 | 3 | 4 | 5 | 6 | Remark |
|---|---|---|---|---|---|---|---|---|
| 506 | lactose | — | 0.10 | — | 0.10 | — | 0.10 | " |
| | PVA-120 | 0.10 | 0.10 | 0.10 | 0.10 | 0.10 | 0.10 | |
| 507 | lactose | 0.08 | — | 0.08 | — | 0.14 | — | " |
| | PVA-120 | — | 0.20 | — | 0.20 | — | — | |

Similarly to Example 1, a set of Samples 501 to 507 was preserved at 45° C. and 80% RH for 4 days (Set B).

Each of samples of both Sets A and B was exposed to light in the same manner as in Example 4 and uniformly heated for 30 seconds on a heat block heated at 140° C.

Water was supplied on the coated surface of Dye Fixing Material (R-2) at a rate of 20 ml/$m^2$, and the heated photosensitive material was laminated on the dye fixing material in such a manner that the coated surfaces faced to each other.

The film unit was passed through a laminator heated at 80° C. at a linear speed of 12 mm/sec and then stripped from each other. There was obtained a satisfactory positive image on both of the photosensitive material and the dye fixing material.

$D_{max}$ and $D_{min}$ of the gray part for each of cyan, magenta, and yellow colors were measured. The results obtained are shown in Table 10 below.

TABLE 10

| Set | Sample No. | $D_{max}$ Yellow | Magenta | Cyan | $D_{min}$ Yellow | Magenta | Cyan | Remark |
|---|---|---|---|---|---|---|---|---|
| A | 501 | 2.0 | 2.1 | 2.0 | 0.24 | 0.23 | 0.21 | Comparison |
| A | 502 | 2.1 | 2.1 | 2.1 | 0.20 | 0.19 | 0.18 | " |
| A | 503 | 2.0 | 2.0 | 2.1 | 0.19 | 0.18 | 0.18 | " |
| A | 504 | 2.0 | 2.0 | 2.1 | 0.16 | 0.15 | 0.15 | Invention |
| A | 505 | 2.1 | 2.1 | 2.1 | 0.17 | 0.16 | 0.15 | " |
| A | 506 | 2.0 | 2.1 | 2.0 | 0.16 | 0.16 | 0.15 | " |
| A | 507 | 2.1 | 2.1 | 2.1 | 0.17 | 0.15 | 0.14 | " |
| B | 501 | 2.0 | 2.1 | 2.1 | 0.34 | 0.32 | 0.30 | Comparison |
| B | 502 | 2.1 | 2.1 | 2.1 | 0.26 | 0.25 | 0.25 | " |
| B | 503 | 2.1 | 2.0 | 2.1 | 0.26 | 0.26 | 0.25 | " |
| B | 504 | 2.0 | 2.1 | 2.1 | 0.21 | 0.19 | 0.19 | Invention |
| B | 505 | 2.1 | 2.1 | 2.1 | 0.22 | 0.20 | 0.20 | " |
| B | 506 | 2.1 | 2.1 | 2.0 | 0.22 | 0.20 | 0.19 | " |
| B | 507 | 2.1 | 2.1 | 2.2 | 0.21 | 0.20 | 0.19 | " |

The results of Table 10 clearly demonstrate the effects of the present invention.

EXAMPLE 6

Sample 601 was prepared in the same manner as for Sample 301 of Example 3, except for using 2.5 g of triisononyl phosphate as a high-boiling organic solvent in the 3rd layer.

Samples 602 to 606 were prepared in the same manner as for Sample 601, except for further adding the additive(s) shown in Table 11 below to one or more layers shown.

TABLE 11

| Sample No. | Additive | Layer(s) and Amount of Additive ($gm^2$) 1 | 2 | 3 | 4 | 5 | 6 | Remark |
|---|---|---|---|---|---|---|---|---|
| 601 | none | — | — | — | — | — | — | Comparison |
| 602 | polyvinyl alcohol | — | 0.10 | — | 0.20 | — | 0.10 | " |
| 603 | lactose | 0.20 | — | 0.10 | — | 0.10 | — | " |
| 604 | lactose | — | 0.13 | — | 0.13 | — | 0.14 | Invention |
| | PVA-120 | — | 0.15 | — | 0.15 | — | 0.20 | |
| 605 | maltose | — | — | — | 0.40 | — | — | " |
| | PVA-120 | 0.10 | — | 0.15 | — | 0.10 | — | |
| 606 | galactose | — | 0.20 | — | 0.20 | — | — | " |
| | PVA-120 | — | 0.10 | — | 0.10 | — | 0.25 | |

Similarly to Example 1, a set of Samples 601 to 606 was preserved at 45° C. and 80%RH for 4 days (samples of Set B).

Each of samples of Sets A and B was exposed to light of a tungsten lamp (500 lux) for 1 second through a G, R, or IR color separation filter each having a continuously varying density. The G and R filters were band transmission filters having a transmission of 500 to 600 nm and from 600 to 700 nm, respectively. The IR filter was a filter having a transmission of 700 nm or more.

Water was supplied to the emulsion surface of the exposed photosensitive material at a rate of 12 ml/$m^2$ with a wire bar, and the photosensitive material and Dye Fixing Material (R-1) were brought into contact in such a manner that the coated layers faced to each other.

The film unit was heated for 25 seconds by means of a heat roller set at such a temperature that the film having absorbed water was heated at 93° C. When the dye fixing material was stripped off the photosensitive material, there was obtained a yellow, magenta, or cyan clear image on the dye fixing material in correspondence to the G, R, or IR color separation filter, respectively.

$D_{max}$ and $D_{min}$ of the yellow, magenta, and cyan colors were measured. The results obtained are shown in Table 12 below. The results of Table 12 prove the effects of the present invention.

TABLE 12

| Set | Sample No. | $D_{max}$ Yellow | $D_{max}$ Magenta | $D_{max}$ Cyan | $D_{min}$ Yellow | $D_{min}$ Magenta | $D_{min}$ Cyan | Remark |
|---|---|---|---|---|---|---|---|---|
| A | 601 | 2.1 | 2.2 | 2.2 | 0.21 | 0.20 | 0.18 | Comparison |
| A | 602 | 2.0 | 2.1 | 2.1 | 0.18 | 0.16 | 0.15 | " |
| A | 603 | 2.1 | 2.2 | 2.2 | 0.19 | 0.18 | 0.16 | " |
| A | 604 | 2.1 | 2.1 | 2.1 | 0.13 | 0.14 | 0.12 | Invention |
| A | 605 | 2.1 | 2.2 | 2.2 | 0.13 | 0.13 | 0.11 | " |
| A | 606 | 2.0 | 2.1 | 2.1 | 0.12 | 0.13 | 0.10 | " |
| B | 601 | 2.1 | 2.2 | 2.2 | 0.27 | 0.27 | 0.26 | Comparison |
| B | 602 | 2.0 | 2.1 | 2.1 | 0.23 | 0.22 | 0.20 | " |
| B | 603 | 2.1 | 2.2 | 2.2 | 0.24 | 0.23 | 0.21 | " |
| B | 604 | 2.1 | 2.2 | 2.2 | 0.15 | 0.16 | 0.13 | Invention |
| B | 605 | 2.1 | 2.2 | 2.2 | 0.14 | 0.14 | 0.13 | " |
| B | 606 | 2.0 | 2.1 | 2.1 | 0.14 | 0.14 | 0.12 | " |

While the invention has been described in detail and with reference to specific embodiments thereof, it will be apparent to one skilled in the art that various changes and modifications can be made therein without departing from the spirit and scope thereof.

What is claimed is:

1. A heat developable color photographic material comprising a support having thereon at least a photosensitive silver halide, a binder, a base precursor and a dye providing compound capable of releasing or forming a diffusible dye in correspondence or counter-correspondence to reduction of the silver halide to silver, said heat developable color photosensitive material further comprising a compound represented by formula (1):

$$C_{6n}(H_2O)_{5n+1} \quad \text{(I)}$$

wherein n represents an integer from 1 to 10.

2. A heat developable color photosensitive material as claimed in claim 1, wherein said compound of formula (I) is present in an amount of from 0.1 to 50% by weight based on the binder.

3. A heat developable color photosensitive material as claimed in claim 2, wherein said compound of formula (I) is present in an amount of from 0.5 to 15% by weight based on the binder.

4. A heat developable color photosensitive material as claimed in claim 1, wherein said binder comprises a combination of gelatin and polyvinyl alcohol.

5. A heat developable color photosensitive material as claimed in claim 4, wherein said polyvinyl alcohol has an average degree of polymerization of 300 or more and a degree of saponification of 60 mol% or more.

6. A heat developable color photosensitive material as claimed in claim 5, wherein said polyvinyl alcohol has an average degree of polymerization of 1,000 or more and a degree of saponification of 80 mol% or more.

7. A heat developable color photosensitive material as claimed in claim 4, wherein said gelatin is present in an amount of 20 g or less per $m^2$.

8. A heat developable color photosensitive material as claimed in claim 7, wherein said gelatin is present in an amount of 10 g or less per $m^2$.

9. A heat developable color photosensitive material as claimed in claim 4, wherein said polyvinyl alcohol is present in an amount of from 0.1 to 50% by weight based on the gelatin.

10. A heat developable color photosensitive material as claimed in claim 9, wherein said polyvinyl alcohol is present in an amount of from 0.5 to 20% by weight based on the gelatin.

11. A heat developable color photosensitive material as claimed in claim 4, wherein said polyvinyl alcohol is present in an amount of from 500 to 5% by weight based on the compound of formula (I).

12. A heat developable color photosensitive material as claimed in claim 1, wherein said compound of formula (I) is a monosaccharide represented by formula (I) wherein n is 1.

13. A heat developable color photosensitive material as claimed in claim 1, wherein said compound of formula (I) is an oligosaccharide represented by formula (I) wherein n is from 2 to 6.

* * * * *